US008284122B2

(12) United States Patent
Hagino et al.

(10) Patent No.: US 8,284,122 B2
(45) Date of Patent: Oct. 9, 2012

(54) MATRIX ADDRESSING METHOD AND CIRCUITRY AND DISPLAY DEVICE USING THE SAME

(75) Inventors: Shuji Hagino, Tokyo (JP); Hidetoshi Watanabe, Tokyo (JP); Yuko Furui, Tokyo (JP); Akihiro Iwatsu, Tokyo (JP)

(73) Assignee: TPO Hong Kong Holding Limited, Shatin (HK)

( * ) Notice: Subject to any disclaimer, the term of this patent is extended or adjusted under 35 U.S.C. 154(b) by 612 days.

(21) Appl. No.: 11/920,374

(22) PCT Filed: May 9, 2006

(86) PCT No.: PCT/JP2006/309334

§ 371 (c)(1),
(2), (4) Date: Mar. 12, 2009

(87) PCT Pub. No.: WO2006/123551

PCT Pub. Date: Nov. 23, 2006

(65) Prior Publication Data

US 2009/0213042 A1 Aug. 27, 2009

(30) Foreign Application Priority Data

May 16, 2005 (JP) ..... 2005-143110

(51) Int. Cl.
*G09G 3/20* (2006.01)
*G09G 5/00* (2006.01)

(52) U.S. Cl. ..... 345/55; 345/690; 345/89

(58) Field of Classification Search ..... 345/55, 345/87, 89, 76, 82, 204, 690, 98–100
See application file for complete search history.

(56) References Cited

U.S. PATENT DOCUMENTS 6,335,778 B1 * 1/2002 Kubota et al. ..... 349/151
(Continued)

FOREIGN PATENT DOCUMENTS

JP 2002-175033 6/2002
(Continued)

OTHER PUBLICATIONS

PCT International Search Report of Counterpart PCT Application No. PCT/JP2006/309334.

*Primary Examiner* — Stephen Sherman
(74) *Attorney, Agent, or Firm* — Liu & Liu

(57) ABSTRACT

The invention aims at providing a matrix addressing method and circuitry and display device, which enable power savings without as little degrading the legibility of content of an image as possible. A matrix addressing method for driving pixels arranged over a display area by signals supplied to row electrodes and column electrodes arranged to cross one another. Rich-gray-scale pixel information signals (#0 to #63) are generated in a predetermined number of levels of gray scale according to original pixel information signals, while poor-gray-scale pixel information signals (#0 and #63) are generated in a smaller number of levels of gray scale than the maximum number of levels of gray scale, according to original pixel information signals, and rich-gray-scale pixels driven by the rich-gray-scale pixel information signals (#0 to #63) and poor-gray-scale pixels driven by the poor-gray-scale pixel information signals (#0 and #63) are mixed and coexist discretely in at least a part of the display area in a predetermined mixing pattern to display the same image object in a predetermined mode.

13 Claims, 18 Drawing Sheets

U.S. PATENT DOCUMENTS

| | | | | |
|---|---|---|---|---|
| 7,532,195 | B2 * | 5/2009 | Sampsell | 345/108 |
| 2002/0011979 | A1 * | 1/2002 | Nitta et al. | 345/89 |
| 2002/0093475 | A1 * | 7/2002 | Hashimoto | 345/87 |
| 2005/0052477 | A1 * | 3/2005 | Kudo et al. | 345/690 |

FOREIGN PATENT DOCUMENTS

| | | |
|---|---|---|
| JP | 2003-084722 | 3/2003 |
| JP | 2003-228348 | 8/2003 |
| JP | 2003-316334 | 11/2003 |

* cited by examiner

1st Frame
2nd Frame
3rd Frame
4th Frame
5th Frame
6th Frame
(+)R (−)R (+)R (−)R (+)R (−)R (+)R (−)R (+)R (−)R (+)R (−)R (+)R (−)R (+)R (−)R
(−)R ↑ ↑ (+)R ↑ ↑ (−)R ↑ ↑ (+)R ↑ ↑ (−)R ↑ ↑ (+)R
(−)R (+)R (−)R (+)R (−)R (+)R (−)R (+)R (−)R (+)R (−)R (+)R (−)R (+)R (−)R (+)R
(+)R ↑ ↑ (−)R ↑ ↑ (+)R ↑ ↑ (−)R ↑ ↑ (+)R ↑ ↑ (−)R
(+)R (−)R (+)R (−)R (+)R (−)R (+)R (−)R (+)R (−)R (+)R (−)R (+)R (−)R (+)R (−)R
(−)R (+)R (−)R (+)R (−)R (+)R (−)R (+)R (−)R (+)R (−)R (+)R (−)R (+)R (−)R (+)R
L1 L2 L3 L4 L5 L6 L7 L8 L9 L10 L11 L12 L13 L14 L15 L16
F F F

MATRIX ADDRESSING METHOD AND CIRCUITRY AND DISPLAY DEVICE USING THE SAME

BACKGROUND OF THE INVENTION

1. Field of Invention

The present invention relates broadly to a matrix addressing circuitry. The invention relates more particularly to a matrix addressing method and circuitry that drive row electrodes and column electrodes arranged to cross one another. The invention also relates to a display device using such addressing circuitry.

2. Related Art

Patent Document 1 discloses a method for displaying an image using a matrix display with image elements that radiate light in response to power supply, which comprises the steps of selecting a display mode from at least a first mode and a second mode, displaying an image on the display when the first mode is selected, and changing an image to display when the second mode is selected so that power consumption to display the image in the second mode is smaller than power consumption to display the image in the first mode. According to this method, power consumption is reduced in the second mode.

In the method described in this document, in the second mode, an image is displayed while decreasing the display area of the image that is an object to display, or decreasing the number of active display pixels without varying the display area and distributing non-active display pixels over the display area.

[Patent Document 1] Japanese Patent Application Laid-Open No. 2004-46125 (particularly, see claim 1, FIGS. 3b, 4b, 4c, 4d, 5b, 6a, 6b, 7a, and 7b, and Paragraph Nos. [0022] to [0027])

However, in the method described in Patent Document 1, a displayed image is scaled down when decreasing the display area of the image that is an object to display, and so there is a risk of extremely degrading the legibility of content of the image. Further, when decreasing the number of active display pixels, part of the original image information is uniformly set at a fixed value, and non-active pixels become prominent, thereby largely degrading the legibility of content of the image also.

SUMMARY OF THE INVENTION

The invention has been made in view of the above problems, and its object is to provide a matrix addressing method and circuitry and display device, which enable power savings with as little degrading the legibility of content of an image as possible.

It is another object of the invention to provide a matrix addressing method and circuitry and display device capable of providing a new display mode that can be adapted to for actually applied equipment while reducing power consumption.

In order to achieve the aforementioned objects, a first aspect of the invention is a matrix addressing method for driving pixels arranged over a display area by signals supplied to row electrodes and column electrodes arranged to cross one another, the method comprising the following steps of generating rich-gray-scale pixel information signals in a predetermined number of levels of gray scale in accordance with original pixel information signals; generating poor-gray-scale pixel information signals in a smaller number of levels of gray scale than the predetermined number of levels of gray scale in according with original pixel information signals; and discretely mixing rich-gray-scale pixels driven by the rich-gray-scale pixel information signals and poor-gray-scale pixels driven by the poor-gray-scale pixel information signals to coexist in at least a part of the display area in a predetermined mixing pattern to display the same image object in a predetermined mode.

In this way, since part of pixels coexisting in the image object are driven by the poor-gray-scale pixel information signals, power consumption is reduced as compared with the case where all the pixels of the image object are driven only by the rich-gray-scale pixel information signals, and since the poor-gray-scale pixel information signals are determined depending on the original pixel information signals and the poor-gray-scale pixels coexist discretely with the rich-gray-scale pixels, the quality of the original image is not degraded so much. It is noted that "the predetermined number of levels of gray scale" described herein means the number of gray scale levels set in an ordinary display mode in relatively plain cases, but it covers the number of gray scale levels different from the number of gray scale levels set in an ordinary display mode when such a number of gray scale levels is applied to generation of the rich-grey-scale pixel information signals in the predetermined mode.

In this aspect, the mixing pattern and/or a ratio between the number of the rich-gray-scale pixels and the number of the poor-gray-scale pixels may be made variable. It is thus possible to select the optimal ratio and mixing pattern for an image to be displayed, and to achieve higher legibility of content of the image.

Further, the poor-gray-scale pixels may be driven by the poor-gray-scale pixel information signals at a lower frequency than that of the rich-gray-scale pixels. This means that the refresh rate of the poor-gray-scale pixels is made lower than that of the rich-gray-scale pixels, thereby reducing the energy to drive the poor-gray-scale pixels, and so being possible to achieve further power saving. Preferably, in driving the poor-gray-scale pixels at the lower frequency, it is preferable to perform the row electrode selecting operation to select only part of the row electrodes associated with the rich-gray-scale pixels, while passing other part of the row electrodes associated with only the poor-gray-scale pixels. It is thereby made possible to save the energy consumed in select the row electrodes. Further, it is desirable that the poor-gray-scale pixel information signals only include a signal with a minimum driving level of the pixel and a signal with a maximum driving level of the pixel. This is because such a signal with the minimum or maximum driving level belongs to a saturation region or its vicinity of brightness characteristics, and the obtained brightness can be maintained constant (at a darkest state or brightest state) even when the driving frequency (refresh rate) is decreased for such a signal.

Moreover, gamma correction characteristics applied to the rich-gray-scale pixel information signals may be variable in accordance with a spatial arrangement manner in the display area of the poor-gray-scale pixels driven by the poor-gray-scale pixel information signals, an input instruction or other setting. It is thus possible to select an optimal gamma correction characteristic for an image to be displayed. Further, when an arrangement of the rich-gray-scale pixels and the poor-gray-scale pixels in the display area is switched at predetermined timing or periodically, since a placement of the poor-gray-scale pixels is switched with the passage of time, there can be expected an advantage of preventing so-called burning-in of a screen, for example.

In a featured embodiment, the poor-gray-scale pixel information signals are obtained by performing a dithering processing on the original pixel information signals. The poor-gray-scale pixel information signals are thereby allowed to express a large number of halftones only using two levels, the darkest and brightest levels, and in addition to the advantage specific to the saturation region of brightness characteristics as described above, favourable display aspects can thus be derived. Further, it is possible to provide quite a new display mode that has never happened before.

Moreover, in order to achieve the above-mentioned objects, a second aspect of the invention is a matrix addressing circuit for driving pixels arranged across a display area by signals supplied to row electrodes and column electrodes arranged to be mutually crossed, comprising: a rich-gray-scale generating unit for generating rich-gray-scale pixel information signals in a predetermined number of levels of gray scale in accordance with original pixel information signals; a poor-gray-scale generating unit for generating poor-gray-scale pixel information signals in a smaller number of levels of gray scale than the predetermined number of levels of gray scale in accordance with original pixel information signals; and a mixing control unit coupled to the rich-gray-scale generating unit and the poor-gray-scale generating unit for discretely mixing rich-gray-scale pixels driven by the rich-gray-scale pixel information signals and poor-gray-scale pixels driven by the poor-gray-scale pixel information signals to coexist in at least a part of the display area in a predetermined mixing pattern to display the same image object in a predetermined mode, and the same advantages can be expected as in the above-mentioned aspect.

In this aspect, it may be possible that the rich-gray-scale generating unit comprises a gray-scale voltage generating circuit with amplifiers respectively receiving a plurality of gray-scale voltages having gradually level-shifted values, and a selecting circuit that selects any of outputs of the amplifiers for each pixel, or each predetermined display unit in accordance with a pixel information signal indicating a level of gray scale of the pixel or the display unit and outputs it as the rich-gray-scale pixel information signals, and the poor-gray-scale generating unit comprises a switch circuit which disconnects power supply to all the amplifiers or connects power supply only to a predetermined number of amplifiers corresponding to predetermined gray scale levels among the all amplifiers while disconnecting power supply to the other amplifiers in the predetermined mode, and a setting circuit coupled to the selecting circuit for setting the selecting circuit in a condition to select either of a power supply voltage and a ground voltage and/or any of output signals of the amplifiers given the power supply in accordance with a selection control signal responsive to the original pixel information signal in the predetermined mode to output the selected one as the poor-gray-scale pixel information signal. Further, the poor-gray-scale generating unit may comprise a signal processing circuit that performs dithering processing on the original pixel information signal, an output of the signal processing circuit being used as the selection control signal in the predetermined mode. Furthermore, the mixing control unit may comprise a supplying circuit coupled to the switch circuit and the selecting circuit for supplying a control signal to the switch circuit and the selecting circuit in the predetermined mode to switch between one state where the selecting circuit outputs the rich-gray-scale pixel information signal and the other state where the selecting circuit outputs the poor-gray-scale pixel information signal for each scanning line or each pixel in accordance with the predetermined mixing pattern.

In a preferred embodiment, it further comprises: a buffer amplifier or a switch coupled to the selecting circuit and supplied with an output signal of the selecting circuit, wherein in the predetermined mode the buffer amplifier or switch is controlled to output the poor-gray-scale pixel information signal during a prescribed frame of a sequence consisting of a plurality of frames and to break the output of the poor-gray-scale pixel information signal in at least one remainder frame of the sequence. It is thereby possible to achieve savings of the energy to drive the poor-gray-scale pixels as described above. When a circuit comprises a row electrode driving unit coupled to the buffer amplifier or the switch for performing row electrode selecting operation to select only a part of the row electrodes associated with the rich-gray-scale pixels while passing other part of the row electrodes associated with only the poor-gray-scale pixels in the predetermined mode, and the row electrode is passed corresponding to an output breaking state of the poor-gray-scale pixel information signal, it is possible to also save the energy consumed to select the row electrodes with reliability, thus being preferable.

Further, when the predetermined mode includes a plurality of sub-modes, and the gray-scale voltage generating circuit is set with amplifiers to be powered for each sub-mode, it is possible to switch the number of levels of gray scale of the poor-gray-scale pixels in stages.

The invention further provides display devices configured by using the above-mentioned aspects and their subordinate concepts.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

The above-mentioned aspects and other implementation modes of the invention will be described in more detail below with reference to accompanying drawings by way of embodiments.

Embodiment 1

Figure 1:
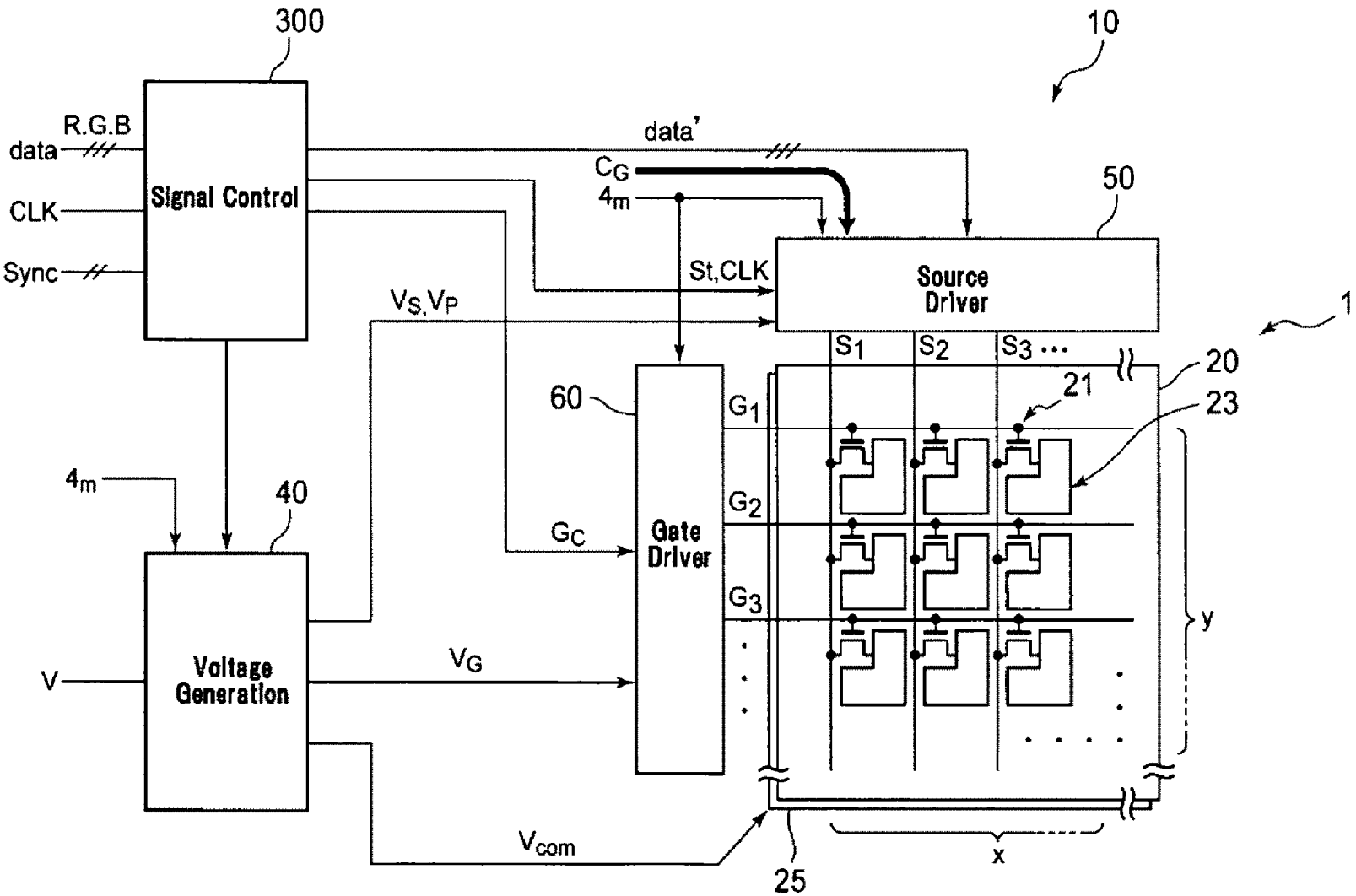
FIG. 1 is a block diagram showing a schematic basic configuration of a liquid crystal display device according to a first embodiment of the invention.

FIG. 1 illustrates a schematic basic configuration of a liquid crystal display device according to an embodiment of the invention.

In the figure, this liquid crystal display device is principally comprised of a liquid crystal display panel 1 of, for example, transmissive normally white mode, and peripheral circuitry for generating signals and voltages required to control and/or drive the panel 1 and supplying them to the panel.

The liquid crystal display panel 1 has a liquid crystal layer (not shown) perform optical modulation in accordance with an image to be displayed, the liquid crystal layer being sandwiched between two opposite transparent substrates. In this embodiment, the liquid crystal display panel 1 adopts an active matrix type structure, and on one substrate 20 on its rear side, for example, field-effect thin-film transistors (TFTs) 21 as pixel-driving active elements are arranged in matrix form corresponding to respective pixels in a predetermined display area on the side opposed to the liquid crystal layer. The gate electrodes of the TFTs 21 are connected to a plurality of row electrodes Gn (n=0, 1, 2, . . . , y; hereinafter, referred to as "gate lines" as appropriate) extending in the lateral (horizontal) direction in the display area in parallel with one another to constitute so-called scanning lines. The source electrodes of the TFTs 21 are connected to a plurality of column electrodes Sm (m=0, 1, 2, . . . , x; hereinafter, referred to as "source lines" as appropriate) extending in the longitudinal (vertical) direction in the display area in parallel with one another to constitute so-called signal lines. The drain electrode of each TFT 21 is connected to a pixel electrode 23.

A front-side substrate 25 is the other substrate of the display panel 1, opposed to the rear substrate 20 with clearance therebetween, and is provided with a common electrode (not shown) formed over a main plane (inner plane of the panel) opposite to the pixel electrode 23. The clearance between the rear substrate 20 and the front substrate 25 is filled with a liquid crystal medium not shown to form a liquid crystal layer.

The TFTs 21 are turned on selectively for each row by a gate signal as a row selecting signal supplied through the gate line Gn, and controlled in driving states corresponding to pixel information to be displayed, by levels of source signals as column information signals (or pixel information signals) supplied through the source lines Sm to the TFTs having been turned on. The pixel electrodes 23 are supplied with the potentials corresponding to the driving states by the drain electrodes. By an electric field of a strength determined by a difference between the pixel electrode potential and a level of voltage supplied to the common electrode, the molecular orientation of the liquid crystal medium is controlled for each pixel electrode. Thus, the liquid crystal medium is allowed to modulate the backlight from a backlight system not shown and control an amount of the light transmitted to the front side for each pixel in accordance with the pixel information. Details of the basic constitution of the liquid crystal display panel are well known in various documents, and so further descriptions thereof are omitted herein.

The peripheral circuitry shown as structural elements other than the display panel 1 in FIG. 1 constitutes a matrix addressing circuit 10. The matrix addressing circuit 10 has a signal control section 300 including image signal processing means, a reference voltage generating section 40 that supplies respective reference voltages including the so-called common voltage signal to supply to the common electrode to required sections, a source driver 50 as column driving means, and a gate driver 60 as row driving means.

The signal control section 300 receives image data signals "data" respectively used for red (R), green (G) and blue (B), a dot clock signal CLK, and a synchronization signal SYNC including horizontal and vertical sync signals from signal supplying means not shown. Based on timings of the clock signal CLK and synchronization signal Sync, the signal control section 300 generates image data signals "data" suitable for the display panel 1 from the received image data signals to transfer them to the source driver 50. Further, based on the clock signal CLK and synchronization signal Sync, the signal control section 300 generates a control signal St to sync-operate the source driver 50 and a control signal $G_C$ to control the gate driver 60, and supplies a necessary timing signal to the voltage generating section 40. By this means, the operation of the matrix addressing circuit 10 is controlled and synchronized.

Based on a supply voltage V from the power supply not shown, the voltage generating section 40 generates power supply voltages required for the source driver 50 and gate driver 60 to supply thereto. Further, based on the supply voltage V, the voltage generating section 40 generates a voltage signal $V_{com}$ suitable for the common electrode formed on the front substrate 25 in the display panel 1 to supply thereto.

The source driver 50 has a digital-analogue converter for each of image data signals of R, G and B, converts the image data signals of the respective colors to analogue signals for each horizontal scanning period, and generates for each color pixel information signals carrying pixel information pieces to be displayed for one horizontal scanning period (i.e. pixel information for one scanning line (for pixels associated with one gate line)). Each of the pixel information signals corresponds to an image signal indicating a gray-scale level to be represented for at least one pixel that is a predetermined display unit, and is held for a period after one horizontal scanning period begins until the next horizontal scanning period comes, or for a predetermined period of time within such a period, while the pixel information signals are supplied to the individually corresponding source lines. It is noted that the clock signal CLK and control signal St supplied to the source driver 50 are bases to determine timings of the horizontal scanning period in the display operation such as analogue conversion and voltage output to the source bus lines.

In response to the control signal $G_C$ from the signal control section 300, the gate driver 60 selectively activates the gate bus lines in the display panel 1, for example, selectively supplies a predetermined high voltage to the gate bus lines sequentially or in a prescribed pattern. The activated gate bus line turns on the TFTs connected thereto, while the pixel information signal is supplied to the sources of these TFTs, whereby the TFTs give the potential corresponding to the pixel information to a corresponding liquid crystal medium portion via their drains and pixel electrodes, and thus the electric field and state of the liquid crystal molecular orientation of the medium portion are determined. Therefore, all the pixels related to the scanning line or row are optically modulated concurrently in accordance with the pixel information for one scanning line.

It is noted that the display panel 1 is actually subjected to the so-called alternate driving by control of the source driver 50, gate driver 60 and common voltage signal $V_{com}$, but this respect is not described herein for the sake of simplicity of the description. However, it is noted that this embodiment does not exclude such an alternate driving manner. For the alternate driving, Japanese Patent Application Laid-Open No. 2003-114647 and so on are referred to.

The voltage generating section 40, source driver 50 and gate driver 60 have a function of varying a driving manner of source and gate lines according to a display mode. To this end, they each are supplied with a mode signal $\mathbf{4}_m$ from a system control section not shown to make their outputs according to the mode indicated by the mode signal. The mode signal $\mathbf{4}_m$ and driving manner of the sections will be further clarified below. The source driver 50 is further coupled with a gamma control bus $C_G$ to subject the image data to gamma correction while altering the correction characteristics in accordance with the mode. The gamma correction will also be described later.

Now a configuration of the source driver 50 will be described.

Figure 2:
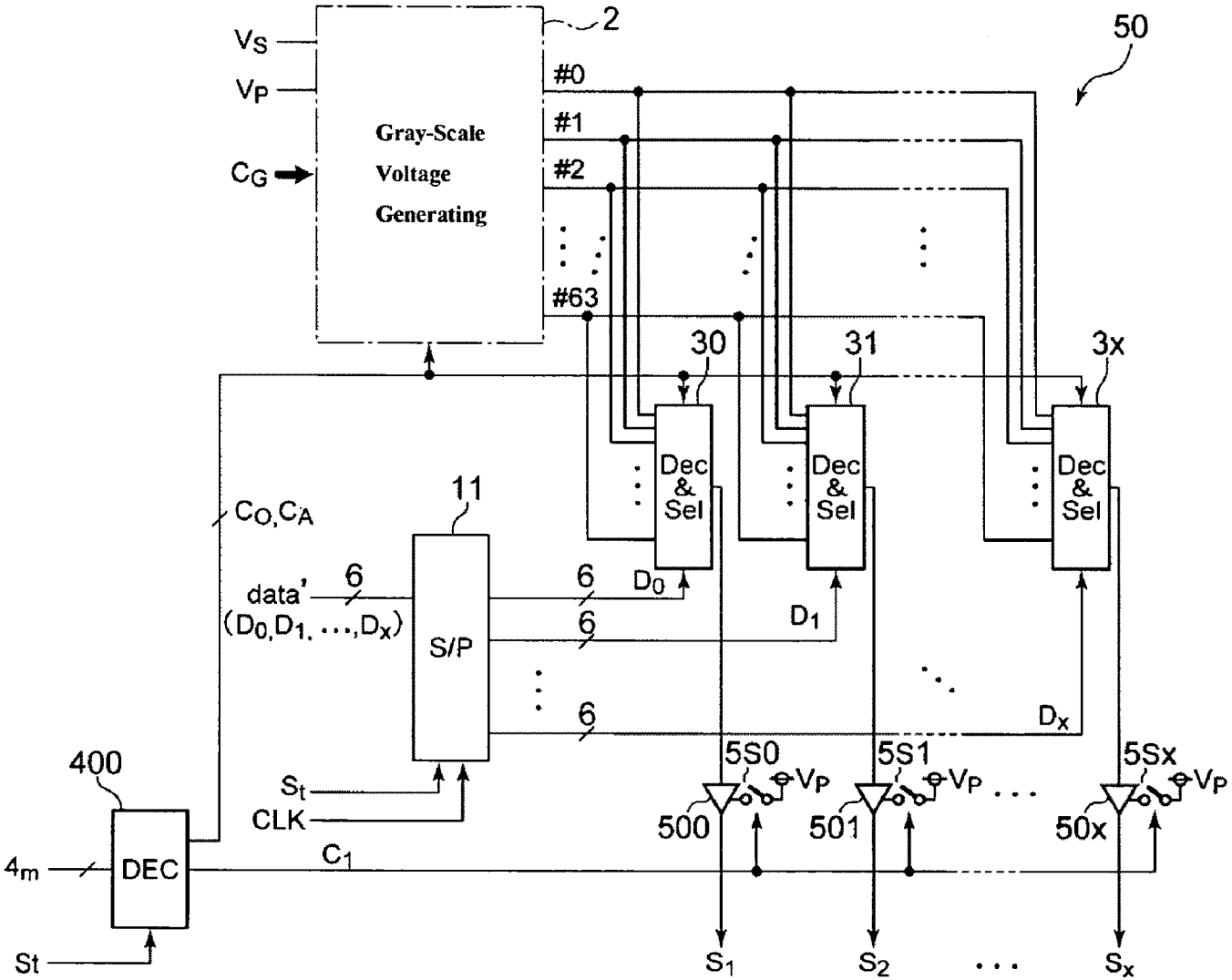
FIG. 2 is a block diagram showing an internal configuration of a source driver shown in FIG. 1.

FIG. 2 shows in function block diagram a general configuration of the source driver 50, and it should be mindful that the shown configuration is formed for each of R, G and B pixels.

The voltage generating section 40 supplies the supply voltages Vs and Vp to gray-scale voltage generating circuit 2. The gray-scale voltage generating circuit 2 generates the maximum number (64 in this embodiment) of gray-scale voltages (hereinafter, described as #0 to #63 from the highest voltage to the lowest voltage) required for the display panel, and details thereof will be described later. The gray-scale voltage generating circuit 2 is further supplied with a signal $C_O$ according to a mode signal $\mathbf{4}_m$ supplied from the system control section not shown and consisting of at least one bit indicating a display mode on how to drive the pixel. The mode signal $\mathbf{4}_m$ is decoded in a mode decoder 400, and converted into the control signal $C_O$ adapted to the number of gray-scale levels to be represented in displaying pixels associated with one scanning line, based on the bit value of the mode signal. The details thereof will be described later. The gray-scale voltage generating circuit 2 is furthermore supplied with a control signal corresponding to the display mode, also from the system section, via the gamma control bus $C_G$.

The gray-scale voltages #0, #1, . . . , #63 outputted from the gray-scale voltage generating circuit 2 are supplied to the respective input terminals of data decoding and voltage selecting circuits (hereinafter, abbreviated as decoding selecting circuits (Dec&Sel)) 30, 31, . . . , 3*x*, where x represents the number of column electrodes i.e. source lines S in the display panel 1 (see FIG. 1). The decoding selecting circuits 30, 31, . . . , 3*x*, are further supplied as their respective selection control signals with pixel data signals having been subjected to the so-called serial/parallel conversion from a data converting circuit 11. Each of the decoding selecting circuits can select any one among the gray-scale voltages in accordance with the selection control signal, and supply the selected voltage to the corresponding source line.

Figure 3:
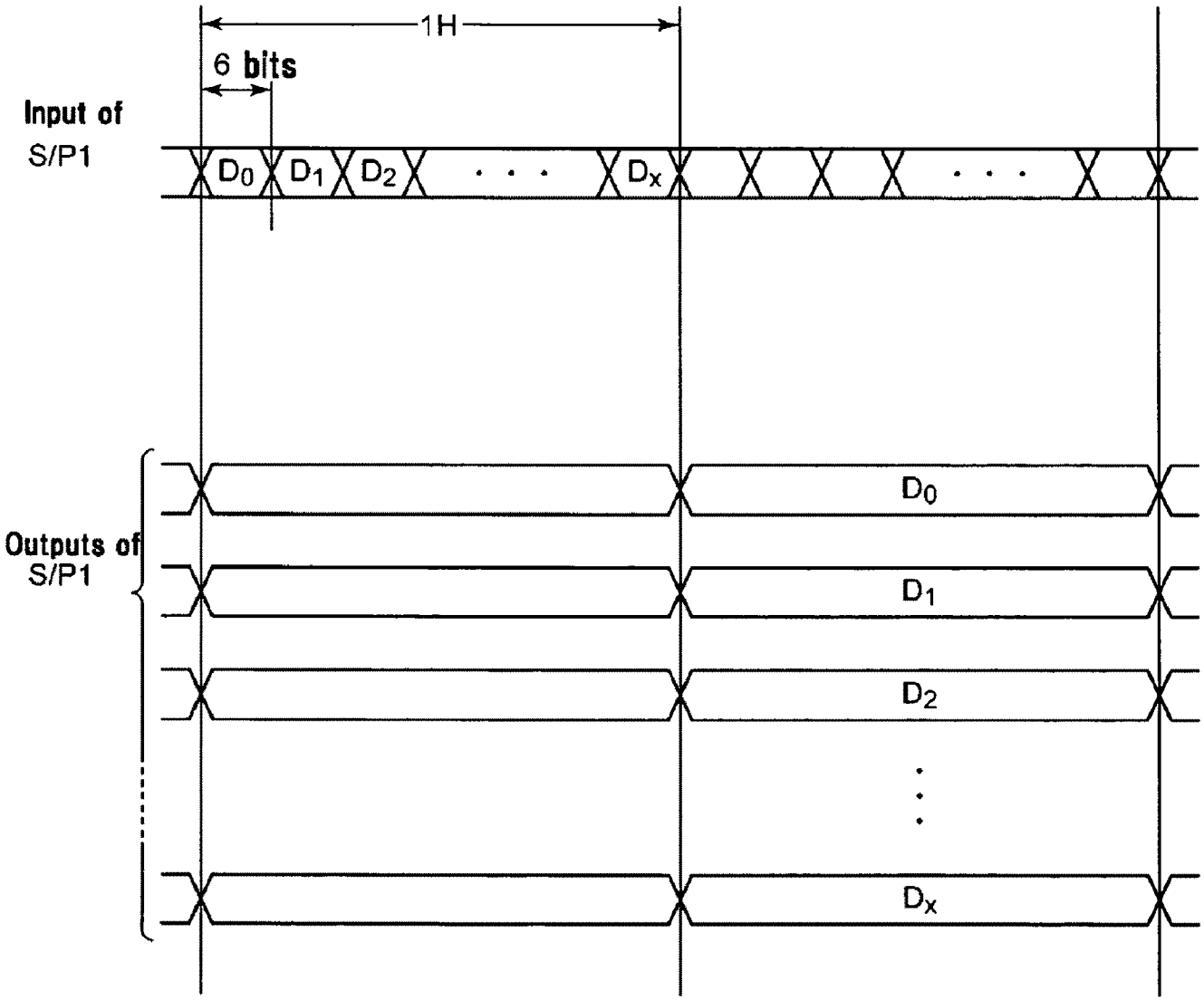
FIG. 3 is a time chart representing the operation of a data converting circuit 11 shown in FIG. 2.

The data converting circuit (S/P) 11 has a function of receiving in series and capturing the input image data signal "data'", and outputting the signal in parallel for each horizontal scanning period. More specifically, as shown in FIG. 3, the input image data signal "data'" has such a form that pixel data blocks $D_0$, $D_1$, $D_2$, . . . , $D_x$, (x is equal to the number of predetermined display units for one scanning line or the number of source lines in the display panel 1) each consisting of 6 bits sequentially appear successively on a time series in synchronization with the dot clock CLK, with each block corresponding to a predetermined display unit in this embodiment (here, information of one pixel). Based on the timing signal St, the data converting circuit 11 holds the pixel data blocks for each horizontal scanning period (H), and simultaneously outputs and updates the pixel data blocks for one horizontal scamming period in the subsequent horizontal scanning period after capturing all the pixel data blocks. Accordingly, as shown by "outputs of S/P1" in FIG. 3, the pixel data blocks $D_0$, $D_1$, $D_2$, . . . , $D_x$ each of 6 bits are outputted concurrently, i.e. in parallel with one another, and inputted to the respective decoding selecting circuits 30, 31, 32, . . . , 3*x*.

Each of the decoding selecting circuits selects a corresponding gray-scale voltage in response to a parallel output of the six-bit pixel data block. Herein, since one pixel data block indicates any of 64 types of information, the decoding selecting circuit decodes the information to select any one of gray-scale voltages #0, #1, . . . , #63 corresponding to the decoding result. The decoding and selection manner will be described later.

It is thus possible to output gray-scale voltages according to the image data signal "data'" to the source lines line-sequentially while updating them for each horizontal scanning period. In addition, according to one of features of the invention, such a manner of outputting gray-scale voltages for each horizontal scanning period is altered in a specific mode, for example, power saving mode. More specifically, in the power saving mode, for pixels (hereinafter, referred to as poor-gray-scale pixels) determined to display in a smaller number of gray-scale levels than normal, such a manner is adopted that once gray-scale voltages have been outputted to the poor-gray-scale pixels, any more gray-scale voltages are not outputted to the poor-gray-pixels in the corresponding horizontal scanning periods during a predetermined number of subsequent frames. To this end, the decoding selecting circuits 30, 31, 32, . . . , 3*x* are provided on their output sides with buffer amplifiers 500, 501, 502, . . . , 50*x* and switches 5S0, 5S1, 5S2, . . . , 5Sx to switch on/off power supply to the amplifiers, respectively. The switches 5S0 to 5Sx are on/off-controlled based on a control signal $C_1$ from the mode decoder 400, and according to a prescribed sequence, power supply to the buffer amplifiers is turned off during the horizontal scanning periods for non-outputting of gray-scale voltage, so that the gray-scale voltages are not outputted to the source lines.

At the time of driving rich-gray-scale pixels in the normal mode and at the time of driving rich-gray-scale pixels in the power saving mode, the control signal $C_1$ becomes a high level, for example, and turns on the switches 5S0 to 5Sx to output any of gray-scale voltages #0 to #63 via the selecting circuit 30 to 3$x$. Meanwhile, at the time of driving poor-gray-scale pixels in the power saving mode, according to the sequence, the control signal $C_1$ becomes the high level and turns on the switches 5S0 to 5Sx temporarily to similarly output the gray-scale voltages in a first frame, and then maintains a low level in a predetermined number of subsequent remaining frames of the sequence to turn off the switches 5S0 to 5Sx, and thereby disconnects outputs of the gray-scale voltages #0 to #63. Then, such operation in the sequence is repeated. Level switching of the control signal $C_1$ is carried out based on the timing signal St.

Figure 4:
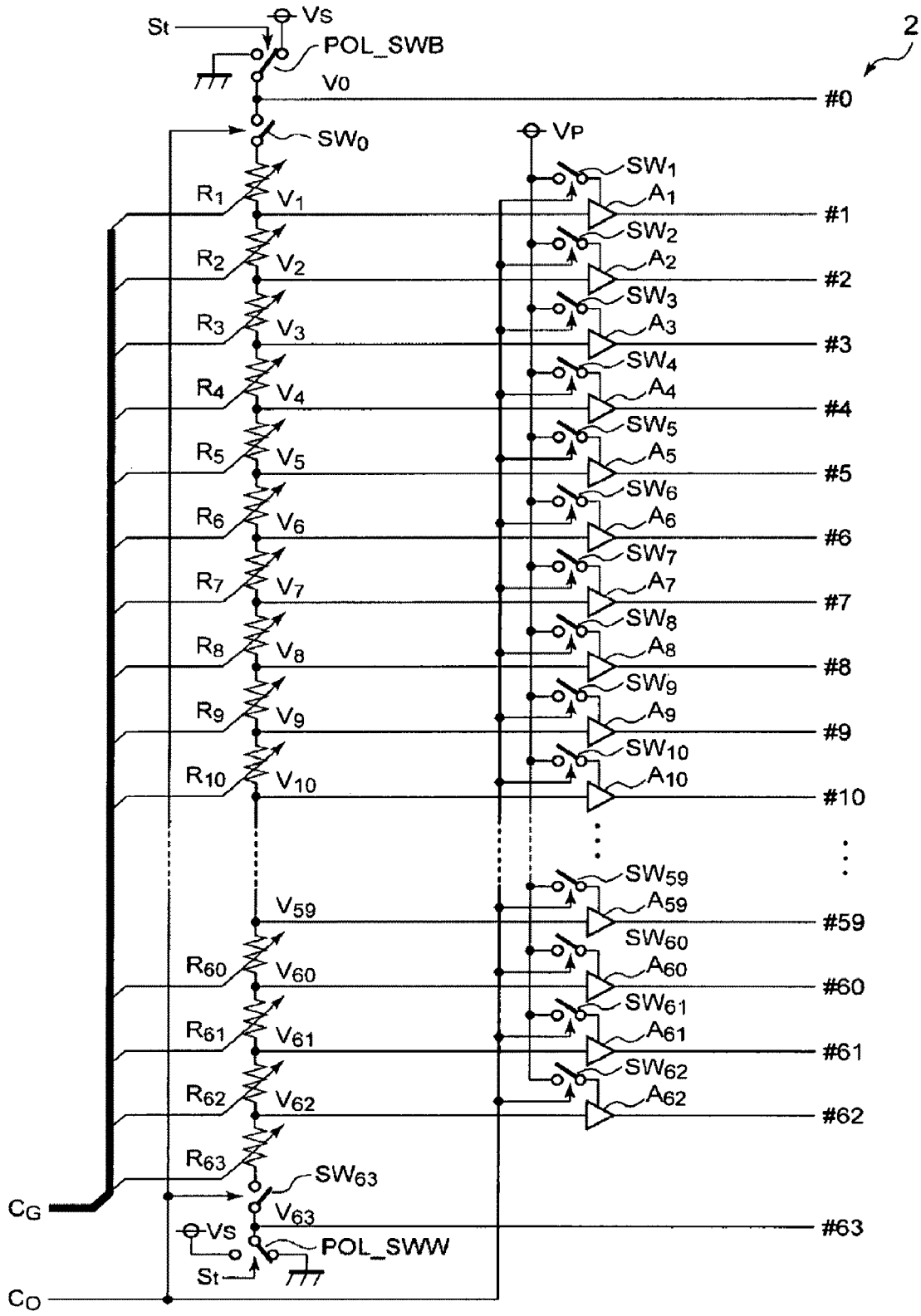
FIG. 4 is a block diagram showing a configuration of a gray-scale voltage generating circuit shown in FIG. 2.

FIG. 4 schematically shows an internal configuration of the gray-scale voltage generating circuit 2.

In FIG. 4, the gray-scale voltage generating circuit 2 has a voltage dividing circuit based on a series circuit of resistance elements $R_1$ to $R_{63}$, and the voltage dividing circuit is provided at its one end and the other end respectively with switch circuits POL_SWB and POL_SWW to invert the polarity of gray-scale voltages as appropriate. In the dark-level-side switch circuit POL_SWB, a first selected terminal is supplied with the basal voltage Vs, a second selected terminal is grounded, and a non-selection terminal is coupled to the resistance element $R_1$ via a switch circuit $SW_0$. In the bright-level-side switch circuit POL_SWW, a first selected terminal is grounded, a second selected terminal is supplied with the basal voltage Vs, and a non-selection terminal is coupled to the resistance element $R_{63}$ via a switch circuit $SW_{63}$. The switch circuits POL_SWB and POL_SWW are both controlled in switching by the control signal St, and in each of the circuits, the first selected terminal is selected to generate positive gray-scale voltages, while the second selected terminal is selected to generate negative gray-scale voltages. FIG. 4 shows a state in generating positive gray-scale voltages, and in this case, the gray-scale basal voltage Vs from the (former-stage) voltage generating section 40 (see FIG. 1) is divided in the voltage dividing circuit with the resistance element $R_1$ at the upper side and the resistance element $R_{63}$ at the lower side.

As shown in the figure, divisional voltages $V_0$ to $V_{63}$ are obtained from tap outputs at common connection points of the voltage dividing resistance elements, and at a voltage supply point and a ground point. In this embodiment, the divisional voltages except voltages from the voltage supply point and ground point are inputted to buffer amplifiers $A_1$ to $A_{62}$ respectively. Each of the amplifiers performs predetermined amplification (in this embodiment, at an input/output ratio of 1.0) on the input divisional voltage. The minimum voltage (for example, corresponding to the brightest display state) from the ground point, the maximum voltage (for example, corresponding to the darkest display state) and intermediate voltages from the amplifiers are supplied to the decoding selecting circuits 30 to 3$x$ as voltages to eventually be supplied to the source lines as gray-voltages #0, #1, . . . , #63.

In generating negative gray-scale voltages, the switch circuits POL_SWB and POL_SWW are controlled to select the second selected terminal differently from in FIG. 4, and the basal voltage Vs is divided by the voltage dividing circuit with the resistance element $R_1$ at the lower side and the resistance element $R_{63}$ at the upper side. Therefore, it is possible to switch between positive gray-scale voltages and negative gray-scale voltages by the control signal St. According to such switching, it is possible to implement alternating of the pixel information signals. It is noted for another example of alternating configuration that the basal voltage Vs may be directly supplied to a point of $V_0$ and the point of $V_{63}$ may be directly coupled to a ground point, instead of using polarity inversion switches POL_SWB and POL_SWW so that the point of $V_0$ is supplied with the positive maximum voltage (+Vs) or negative maximum voltage (−Vs) as the basal voltage Vs according to the polarity to be represented.

A feature of this embodiment in the gray-scale always voltage generating circuit 2 is that all gray-scale voltages #0, #1, . . . , #63 are outputted in the normal mode, but in the power saving mode, all the gray-scale voltages are outputted in some horizontal scanning periods while outputting only part of the gray-scale voltages, in this example, only the minimum voltage $V_{63}$ and maximum voltage $V_0$ in the other horizontal scanning periods. To this end, switch circuits $SW_1$ to $SW_{62}$ are provided between the positive power supply input terminals of the buffer amplifiers $A_1$ to $A_{62}$ and a power supply voltage Vp for the amplifiers, and switch circuits $SW_{63}$ and $SW_0$ are further provided respectively between the switch POL_SWW and the resistor $R_{63}$ and between the switch POL_SWB and the resistor element $R_1$, so that power supply to the amplifiers and dividing resistances is turned on at the time of outputting all the gray-scale voltages while being turned off at the other time in the power saving mode. The on/off operation of the switch circuits is performed using the control signal $C_O$. When the mode signal $\mathbf{4}_m$ indicates the normal mode, the mode decoder 400 always provides the control signal $C_O$ with, for example, a high level to turn on all the switch circuits $SW_0$ to $SW_{63}$. When the mode signal $\mathbf{4}_m$ indicates the power saving mode, the mode decoder 400, on one hand, similarly provides the control signal $C_O$ with a high level to turn on all the switch circuits $SW_0$ to $SW_{63}$ in horizontal scanning periods associated with pixels (hereinafter, referred to as rich-gray-scale pixels) determined to display in the same number of gray-scale levels as in normal, and on the other hand, provides the control signal $C_O$ with a low level to turn off all the switch circuits $SW_0$ to $SW_{63}$ in horizontal scanning periods associated with the poor-gray-scale pixels mentioned above. By this means, in the horizontal scanning periods associated with the poor-gray-scale pixels in the power saving mode, a gray-scale voltage #0 to perform darkest display by the positive or negative maximum voltage $V_0$ and a gray-scale voltage #63 to perform brightest display by the positive or negative minimum voltage $V_{63}$ are only outputted to the decoding selecting circuits 30 to 30$x$.

Meanwhile, the decoding selecting circuits 30 to 30$x$ also perform the operation in conjunction with the gray-scale voltage generating circuit 2. More specially, each of the circuits 30-30$x$ always selects one from among all gray-scale voltages #0 to #63 in accordance with the pixel data in the normal mode. In addition, in the power saving mode, each of the circuits 30-30$x$ similarly selects one from among all gray-scale voltages #0 to #63 in some horizontal scanning periods, while selecting part of the gray-scale voltages, in this embodiment, either one of the maximum gray-scale voltage #0 and the minimum gray-scale voltage #63 in the other horizontal scanning periods. Whether to select the minimum gray-scale voltage or the maximum gray-scale voltage depends on content of the original pixel data. More specifically, the maximum gray-scale voltage is selected when the pixel data is close to the darkest value, and the minimum gray-scale voltage is selected when the pixel data is close to the brightest value. Thus, in the power saving mode, the decoding selecting circuits 30 to 3$x$ switches the selection manner between selection from all the gray-scale voltages and selection from the minimum and maximum gray-scale voltages. Such switching of the selection manner is achieved by the decoding selecting circuit's operation of receiving the control signal $C_O$ and acting according to a value of the control signal. In other words, following the above-mentioned example, each of the decoding selecting circuits 30 to 30$x$ selects any of all the gray-scale voltages when the control signal $C_O$ has a high level, while selecting either of the maximum gray-scale voltage #0 and the minimum gray-scale voltage #63 when the control signal $C_O$ has a low level. In addition, when the control signal $C_O$ is in high level, each of the circuits 30-3*x* decodes all the six bits of each pixel data block ($D_0$, $D_1$, $D_2$, . . . , $D_x$), and performs selection operation corresponding to any of values of 0 to 63 indicated by the data block. Meanwhile, when the control signal $C_O$ is in low level, each of the circuits 30-3*x* decodes only the most significant bit of the pixel data block, and when the most significant bit is "0" or "1", interprets it as, for example, value 0 or 63 to select the corresponding maximum gray-scale voltage or minimum gray-scale voltage, respectively.

This belongs to the case where the decoding selecting circuits 30 to 3*x* are configured to be adapted to the power saving mode. As another example, instead of inputting the control signal $C_O$ to the decoding selecting circuits 30 to 3*x*, data processing may be carried out such that the most significant bit of each of pixel data blocks ($D_0$, $D_1$, $D_2$, . . . , $D_x$) is copied to the other less significant bits before or immediately after the converting circuit 11 in accordance with the control signal $C_0$ at the time of driving the poor-gray-scale pixels in the power saving mode. In other words, values of the input pixel data in the range of "000000" to "011111" are all treated as "111111", and correspond to, for example, a maximum gray-scale voltage #0. Meanwhile, values of the input pixel data in the range of "100000" to "111111" are all treated as "111111", and correspond to, for example, a minimum gray-scale voltage #63. In this case, the decoding selecting circuits 30 to 3*x* are allowed to have the same configuration as conventional one.

Figure 5:
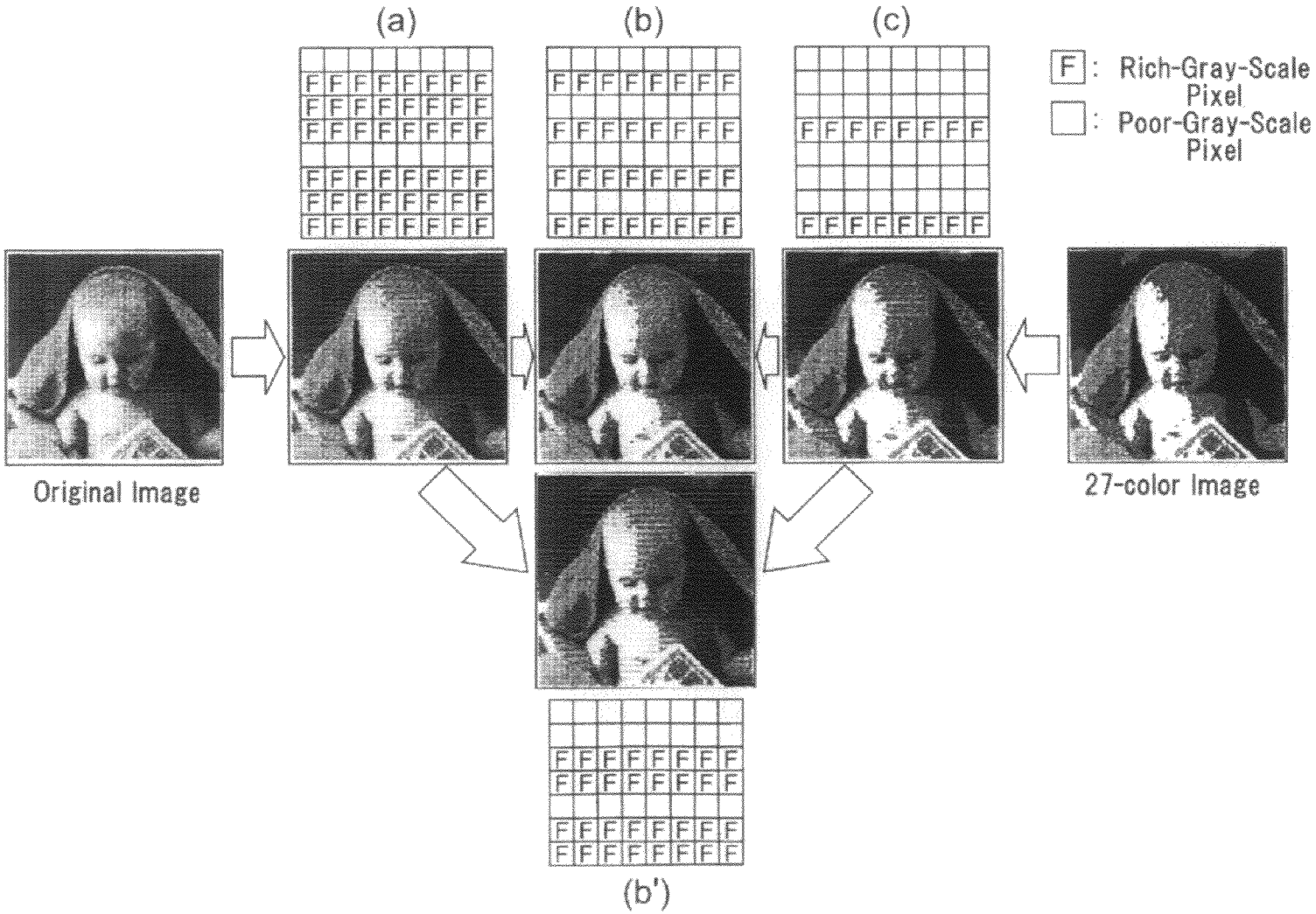
FIG. 5 is an illustration of driving manners and actually obtained images in a display area according to the first embodiment of the invention.

Thus, in the power saving mode, pixels are not always driven in full gray scale levels, and it is possible to mix driving in full gray scale levels and driving in two gray scale levels to coexist. By doing so, the frequency of operating the amplifiers $A_1$ to $A_{62}$ and voltage dividing resistances $R_1$ to $R_{63}$ i.e. the frequency of power supplying is decreased, and power consumption is thereby reduced. FIG. 5 illustrates the driving manner on the display area in the power saving mode.

FIG. 5 schematically shows pixels in matrix form, where each field corresponds to a pixel, and "F" is given in the field when the pixel is a rich-gray-scale pixel, while the field is blanked when the pixel is a poor-gray-scale pixel.

FIG. 5(*a*) shows an example of such a manner that driving in two gray scale levels for the blank poor-gray-scale pixels is performed for one scanning line, and driving in full gray scale levels for the "F" rich-gray-scale pixels is performed for three scanning lines, wherein driving in two gray scale levels for one scanning line and subsequent driving in full gray scale levels for three scanning lines are repeated. In this manner, a rate of driving in two gray scale levels is 25%. As another example to have the same rate, there is a manner in which driving in two-level gray scale levels for two scanning lines and subsequent driving in full gray scale levels for six scanning lines are repeated.

FIG. 5(*b*) shows a manner for alternating between driving in two gray scale levels and driving in full gray scale levels for each scanning line. In this manner, the rate of driving in two gray scale levels is 50%. As another example to have the same rate, there is a manner in which driving in two gray scale levels for two scanning lines and subsequent driving in full gray scale levels for the same number of scanning lines are repeated (FIG. 5(*b'*)).

FIG. 5(*c*) shows an example of such a manner in which that driving in two gray scale levels is performed for three scanning lines, and driving in full gray scale levels is performed for one scanning line. Driving in two gray scale levels for three scanning lines and subsequent driving in full gray scale levels for one scanning line are repeated. In this manner, the rate of driving in only two gray scale levels is 75%. As another example to have the same rate, there is a manner in which driving in only two gray scale levels for six scanning lines and subsequent driving in full gray scale levels for two scanning lines are repeated.

Although FIG. 5 shows manners with the rate of driving in two gray scale levels of 25%, 50% and 75% as typical examples, it is possible to adopt the other percentages and/or various arrangements of the rich-gray-scale pixels and poor-gray-scale pixels.

Thus, in this embodiment, since the rich-gray-scale pixels and poor-gray-scale pixels are mixed to display in the power saving mode, power consumption is eliminated in the amplifiers $A_1$ to $A_{62}$ and voltage dividing resistances $R_1$ to $R_{63}$ in driving the poor-gray-scale pixels, and it is possible to reduce the entire power consumption. Further, a gray-scale voltage to be actually used is generated by assigning rough gray scale to the original pixel data and outputted to a source line, and thus, a value of the poor-gray-scale pixel is determined according to the original pixel data. It is thereby possible to improve the legibility of content of the entire image as compared to the conventional technique for assigning a constant value to predetermined partial pixels irrespective of the original pixel information. Further, the corresponding gray-scale voltages are outputted for rich-gray-scale pixels for each frame period, but at the time of driving poor-gray-scale pixels, on/off control of power supply to the buffer amplifiers 501 to 50*x* by the switches 5S0 to 5Sx and output control of the gate signals supplied to gate lines $G_1$ to $G_y$ from the gate driver 60 as shown in FIG. 2 cause the gray-scale voltages not to be outputted to the poor-gray-scale pixels (i.e. not updated nor refreshed) even after one frame period has elapsed since once outputting gray-scale voltages to the poor-gray-scale pixels. A period of not performing refresh spans a predetermined number of frames. At the time of driving rich-gray-scale pixels in the normal mode and power saving mode, since the control signal $C_1$ has a high level, the switches 5S0 to 5Sx are made ON, and selected gray-scale voltages from the decoding selecting circuits 30 to 3*x* are relayed to the source lines $S_1$ to $S_x$. Meanwhile, at the time of driving poor-gray-scale pixels in the power saving mode, the control signal $C_1$ becomes a high level for example, only at the beginning in a predetermined sequence, and the switches 5S0 to 5Sx are made ON to relay the selected gray-scale voltages from the decoding selecting circuits 30 to 3*x* to the source lines. Thereafter, the control signal $C_1$ becomes a low level, and the switches are made OFF not to relay the selected grey-scale voltages from the decoding selecting circuits 30 to 3*x* to the source lines. After the non-relaying of gray-scale voltages is continued for a predetermined period, the control signal $C_1$ becomes a high level again, and the aforementioned operation is repeated. In conjunction with the operation, the gate driver 60 does not output a gate signal corresponding to the horizontal scanning period according to the low-level period of the control signal $C_1$. In other words, when the control signal $C_1$ is in low level, the gate driver 60 does not output the gate signal to a gate line associated with the poor-gray-scale pixels, even when the timing arrives to output a gate signal for selecting the gate line. Meanwhile, when the control signal $C_1$ is in high level, the gate driver 60 outputs the corresponding gate signal to a gate line associated with the poor-gray-scale pixels and to a gate line associated with the rich-gray-scale pixels. Thus, the row electrode selecting operation adapted to non-refresh operation is achieved such that a gate line related to poor-gray-scale pixels is passed (not scanned or not selected), and a gate line related to rich-gray-scale pixels is scanned (selected), when the control signal $C_1$ is in low level.

Accordingly, the poor-gray-scale pixels in the power saving mode are given output (refresh) of gray-scale voltages at longer intervals i.e. lower rate than in the rich-gray-scale pixels.

In this way, the frequency of using the buffer amplifiers 500 to 50*x* is decreased in the power saving mode, and it is possible to reduce the power consumed in the amplifiers. When refresh with gray-scale voltages is not performed, the electric field across the liquid crystal layer applied via the source line, drain of the TFT and pixel electrode gradually deviates from its initial application state, but the gray-scale voltages for the poor-gray-scale pixels may originally have a relatively large error with respect to the gray-scale voltages of the original pixel information, and it is assumed that its effect on a displayed image is small. Thus, the refresh operation at a low rate is extremely adaptable to a displayed image in the power saving mode. Herein, a predetermined period during which refresh operation is not carried out can be two or more frame periods of an image signal of a still image. It is noted that non-output of the gate signal as described above also eliminates the need of energy to activate the signal, thereby contributing to power savings.

Figure 6:
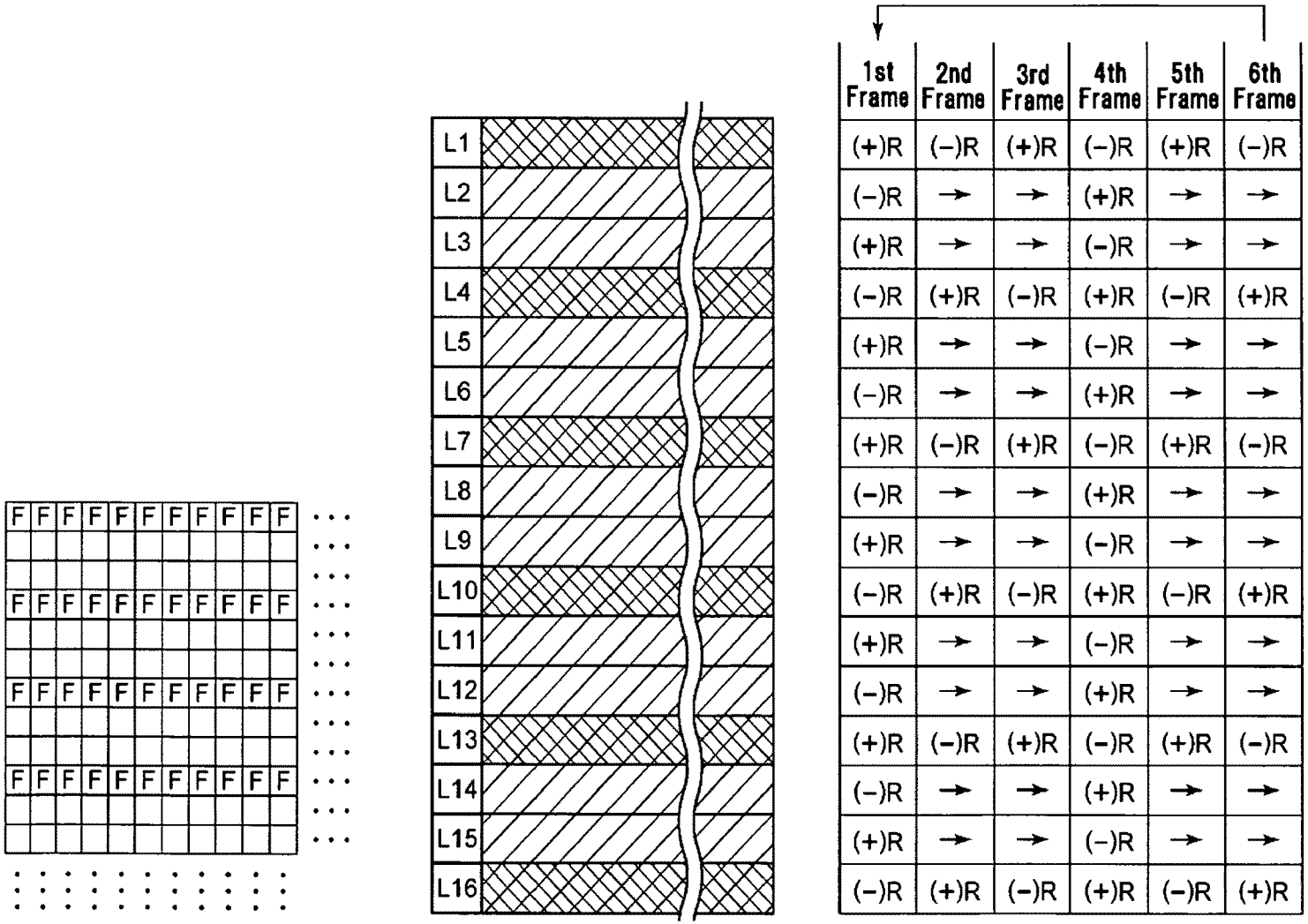
FIG. 6 is an illustration showing a form of refresh operation according to the first embodiment of the invention.

FIG. 6 shows an example of the refresh operation manner in the power saving mode. This example is based on the premise that pixels are driven according to the relationship in arrangement between rich-gray-scale pixels and poor-gray-scale pixels shown at the left side of FIG. 6 in the same way as in FIG. 5.

Illustrated at the centre of FIG. 6 is typical bright/dark display presented by pixels associated with the first scanning line (L1) to the sixteenth scanning line (L16) in the display area. Indicated at the right side of FIG. 6 are details of driving for the pixels associated with these scanning lines for each frame on the time series.

Considered herein is the case where pixel data are provided to all the pixels associated with the scanning lines L1 to L16 for the darkest display. In this case, in the first frame of this sequence, refresh is performed on all the scanning lines, namely the switches 5S0 to 5Sx are turned on to power the buffer amplifiers 500 to 50*x*, and gray-scale voltages #0 corresponding to the darkest display are supplied to the source lines $S_1$ to $S_x$. The column of "the first frame" in the table at the right side in FIG. 6 has divisional fields separated for each scanning line, and "R" given in each field represents that such refresh operation is performed. In the first frame, all the scanning lines are refreshed, while the polarity of the gray-scale voltage is changed alternately for each scanning line. The polarity is indicated by "(+)" or "(−)" attached to "R". Accordingly, it is understood that with respect to pixels associated with the scanning lines of the first frame, gray-scale voltages are supplied to the source lines while a positive polarity and a negative polarity alternate with each other. Such alternating of the driving polarity may be achieved, for example, by alternating the voltage signal $V_{com}$ (see FIG. 1) supplied to the common electrode.

In the second frame, pixels of the scanning lines L1, L4, L7, L10, L13 and L16 (hereinafter, referred to as high-rate refresh lines) are refreshed, but pixels of the other scanning lines (hereinafter, referred to as low-rate refresh lines) are not refreshed with each liquid crystal pixel cell holding the electric field corresponding to the gray-scale voltage outputted by refresh in the first frame. Such a holding state is shown by "→" in the figure. In addition, the driving polarities on the pixels of the high-rate refresh lines in the second frame are different from those in the first frame, and further, driving polarities are different between pixels on one high-rate refresh line and pixels on the other high-rate refresh line spatially adjacent thereto.

Similarly, in the third frame, the pixels of the high-rate refresh lines are refreshed and the pixels of the low-rate refresh lines are not refreshed, but the pixels of the high-rate refresh lines are provided with driving polarities different from those in the second frame.

In the fourth to sixth frames, as in the first to third frames, pixels of all the scanning lines are refreshed in the beginning frame, and in the subsequent two frames, only the pixels of the high-rate refresh lines are refreshed, while the other pixels are in holding. In this case, driving polarities for refreshing pixels in the fourth to sixth frames are different from driving polarities in the first to third frames.

After the sixth frame, returning to the beginning of the sequence (see the return arrow), the operation in the first frame is started again, and the same operation is repeated thereafter.

A displayed image obtained by such pixel driving of refresh and holding is as shown at the centre in the figure. Herein, all the pixels on all the scanning lines are driven in darkest display. The pixels of the high-rate refresh lines L1, L4, L7, L10, L13 and L16 are refreshed with the maximum gray-scale voltages #0 for each frame, and thereby exhibit the darkest state (shown by cross-hatching in the figure) strictly corresponding to the maximum gray-scale voltages. With respect to the pixels of the low-rate refresh lines, the number of refresh times is decreased, and the pixels are only refreshed once every three frames, and exhibit a state (shown by single hatching in the figure) which is close to the darkest state but may deviate slightly from the darkest state with the passage of time from the refresh (e.g. from refresh in the first frame). Such a phenomenon of deviation from the darkest state is caused by decrease in capacitance component related to the pixel electrode and occurrence of leakage current of the TFT.

The above examples have been described on the assumption that all the pixels of all the scanning lines are driven in darkest display. In the case of driving all the pixels of all the scanning lines in brightest display, the pixels of the high-rate refresh lines L1, L4, L7, L10, L13 and L16 exhibit the brightest state strictly corresponding to the minimum gray-scale voltages #63, while the pixels of the low-rate refresh lines exhibit a state possibly deviating slightly from the brightest state. Further, in the case of driving all the pixels of all the scanning lines in intermediate-brightness display, the pixels of the high-rate refresh lines exhibit a gray-scale level strictly corresponding to an intermediate-level of gray-scale voltage, while the pixels of the low-rate refresh lines exhibit a state possibly deviating slightly from a gray-scale level corresponding to the maximum or minimum gray-scale voltage.

It is noted that to facilitate the understanding by intuition, the image in a stripe-pattern is shown at the centre in FIG. 6, but the actual difference is less severe than as shown. Reduction in display quality of pixels of the low-rate refresh lines can be sufficiently negligible in a display mode of the purpose of providing a grasp of the outline of content of the image. Alternatively, in the case of driving all the pixels of the all the scanning lines in darkest or brightest display, it is possible to devise a method of preventing the visual stripe pattern as shown at the centre in FIG. 6 as follows.

Figure 7:
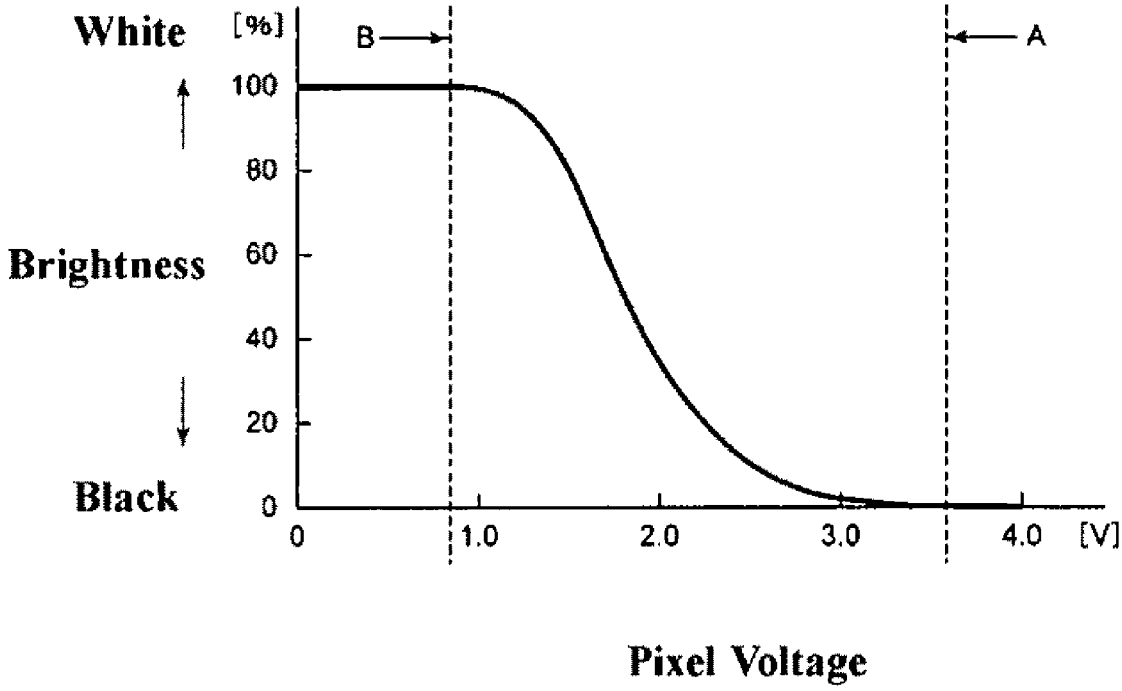
FIG. 7 is a graph of pixel voltage vs. brightness for explaining gray-scale voltages for poor-gray-scale pixels applied in the first embodiment of the invention.

FIG. 7 shows a relationship between a pixel voltage applied to a pixel electrode and a brightness presented by the display device responsive to the voltage. The pixel voltage on the horizontal axis is determined by a gray-scale voltage applied through the source line. The brightness on the vertical axis is indicated with the minimum brightness of 0% and the maximum brightness of 100%. As can be seen from the figure, the brightness generally decreases as the pixel voltage increases, while brightness saturation regions exist in a low-level range and a high-level range of the pixel voltage. The brightness keeps almost 100% without changing in a range of 0V to about 0.8V of the pixel voltage, while keeping almost 0% without changing in a range exceeding about 3.8V of the pixel voltage.

In the case of driving all the pixels of all the scanning lines in same darkest display, when the gray-scale voltage to apply to pixels of low-rate refresh lines is set at, for example, a value corresponding to the pixel voltage of 4.0V, the pixels of the low-rate refresh lines are driven with 4.0V in the first frame, and then, the pixel voltage gradually decreases from 4.0V in the second and third frames. However, the pixel voltage of 4.0V used in the first refreshing has a sufficiently high value in the high-level saturation region A of the brightness characteristics, and so even when the voltage becomes, for example, 3.9V in a holding state of the second frame and 3.8V in a holding state of the third frame, the brightness is maintained at 0%.

In the case of driving all the pixels of all the scanning lines in same brightest display, when the gray-scale voltage to apply to pixels of low-rate refresh lines is set at, for example, a value corresponding to the pixel voltage of 0V, the pixels of the low-rate refresh lines are driven with 0V in the first frame, and then, the pixel voltage gradually increases from 0V in the second and third frames. However, the pixel voltage of 0V used in the first refreshing has a sufficiently low value in the low-level saturation region B of the brightness characteristics, and so even when the voltage becomes, for example, 0.2V in a holding state of the second frame and 0.4V in a holding state of the third frame, the brightness is maintained at 100%.

Thus, by driving the pixels of the low-rate refresh lines with a pixel voltage sufficiently spaced from the critical point (3.8V, 0.8V in the aforementioned example) in the saturation region of the brightness characteristics, it is possible to keep the same brightness as the darkest or brightest state, even when the refresh rate is made to be decreased. Therefore, it is possible to avoid the visual stripe pattern as shown at the centre of FIG. 6.

[Gamma Correction]

It is another feature of this embodiment that voltage dividing resistance elements $R_1$ to $R_{63}$ in the gray-scale voltage generating circuit 2 are of variable resistance type as shown in FIG. 4 and resistance control signals are supplied to their respective control terminals to make resistance values corresponding to the resistance control signals. These resistance control signals are supplied via the gamma control bus $C_G$, and set at values to implement correction characteristics of each mode in voltage dividing resistance values in response to changing of gamma correction characteristics between the normal mode and the power saving mode. Further, as is clarified below, when it is possible to vary the number of gray-scale levels to be provided for the poor-gray-scale pixels for each sub-mode in the power saving mode, the gamma correction characteristics can also be varied for each sub-mode. By this means, it is possible to efficiently improve quality of a displayed image including the poor-gray-scale pixels and/or the legibility of content of the image.

It should be noted that the invention is to use, for example, a display area shown by "Original Image" in FIG. 5 as an area for displaying a single image object (herein, an upper-body of an infant and his/her background), where the entire image in the display area is formed by discretely mixing the rich-gray-scale pixels and poor-gray-scale pixels, and is thus distinct from techniques for dividing a display area into two regions, a region for displaying the rich-gray-scale pixels and another region for displaying the poor-gray-scale pixels, to separately display different image objects.

Embodiment 2

Described in the foregoing is the embodiment where the poor-gray-scale pixels are driven with two gray-scale voltages, the maximum voltage and the minimum voltage, in the power saving mode, and it is possible to represent totally eight colors by using two gray-scale voltages for each of R, G and B pixels. However, the number of driving voltages for the poor-gray-scale pixels are not limited to two as in the foregoing, and can be set at three or more without exceeding the number of gray-scale voltages in the normal mode.

Figure 8:
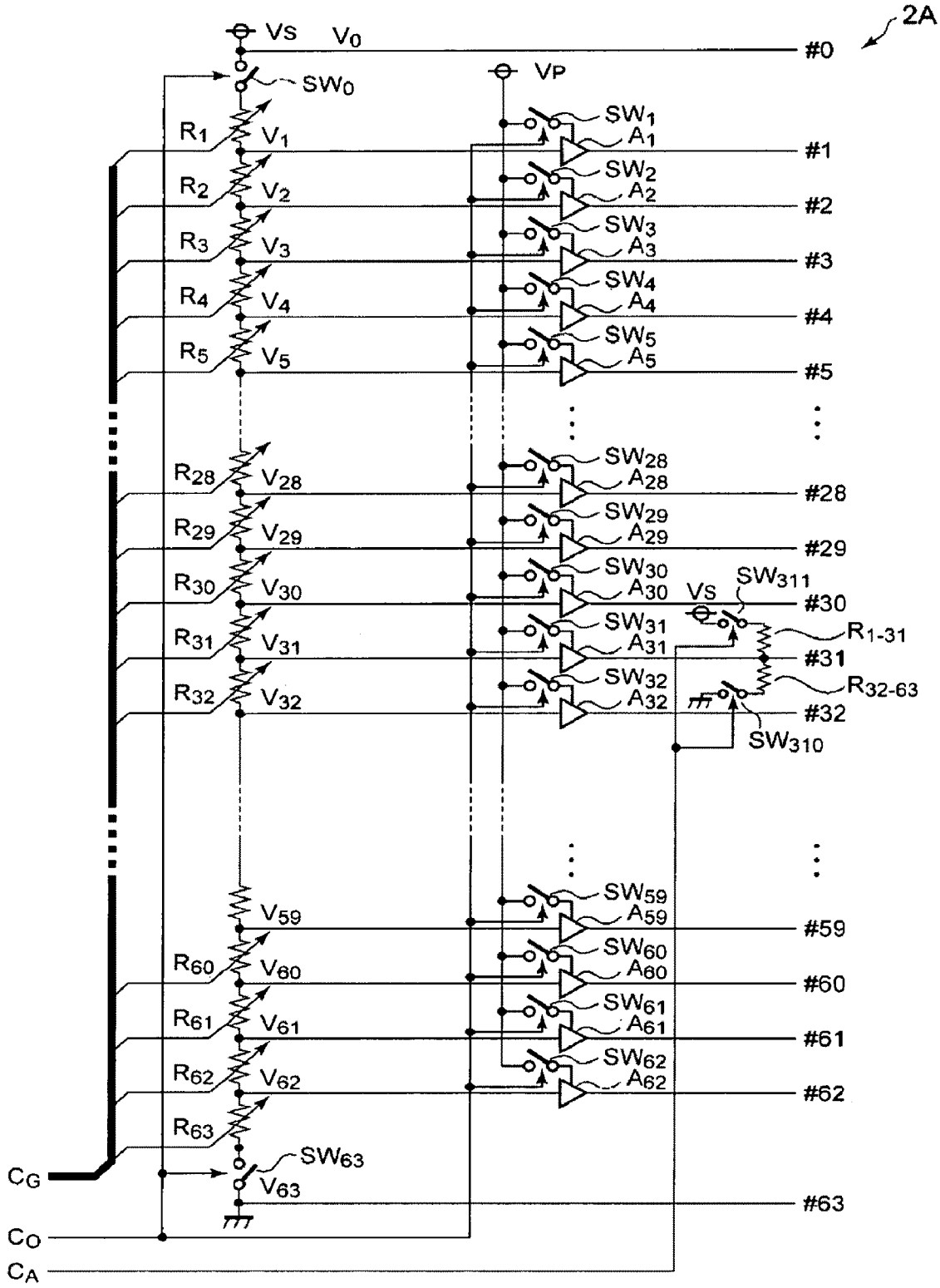
FIG. 8 is a block diagram showing a configuration of a gray-scale voltage generating circuit according to a second embodiment of the invention.

FIG. 8 shows a gray-scale voltage generating circuit 2A according to the second embodiment, and includes a configuration to output three gray-scale voltages in the power saving mode, in addition to the configuration to output two-gray-scale voltages as shown in FIG. 4.

In this embodiment, in order to output not only the maximum and minimum gray-scale voltages #0 and #63 but also a voltage that is almost the middle of the voltages #0, #63 as a gray-scale voltages in the power saving mode, a series circuit comprised of a switch circuit $SW_{311}$, and a resistor $R_{1-31}$ is connected between the 32nd output line (#31) numbered from the maximum voltage and the power supply point (Vs), and a series circuit comprised of a resistor $R_{32-63}$ and a switch circuit $SW_{310}$ is connected between the same output line and a ground point. A second control signal $C_A$ is supplied to control terminals of the switch circuits $SW_{311}$ and $SW_{310}$. It is noted that FIG. 8 omits the alternating structural part as shown in FIG. 4 for the sake of clarity.

In a first sub-mode in the power saving mode, both the control signal $C_O$ and the control signal $C_A$ become at a low level, and the two-level gray-scale voltage output operation is performed as in the configuration in FIG. 4.

In a second sub-mode in the power saving mode, the control signal $C_O$ becomes at a low level, the maximum and minimum gray-scale voltages #0 and #63 are outputted as described with reference to FIG. 4, and the amplifiers $A_1$ to $A_{62}$ and voltage dividing resistors $R_0$ to $R_{62}$ are not powered. However, at the same time, the control signal $C_A$ becomes at a high level to turn on the switch circuits $SW_{311}$ and $SW_{310}$ are made. By this means, the resistors $R_{1-31}$ and $R_{32-63}$ form a voltage dividing circuit, so that a voltage with a substantially average level between the voltage Vs and ground potential is derived as a gray-scale voltage #31. It is noted that a ratio between the resistor $R_{1-31}$ and the resistor $R_{32-63}$ is preferably comparable to a ratio between the total resistance value of the resistors $R_1$ to $R_{31}$ and the total resistance value of the resistors $R_{32}$ to $R_{63}$.

Thus, in the second sub-mode, the control signal $C_O$ has a low level and the control signal $C_A$ has a the high level, thereby outputting three gray-scale voltages #0, #31 and #63. Also in this case, since the resistance elements $R_1$ to $R_{63}$63 and amplifiers $A_1$ to $A_{62}$ are not powered, power consumption is reduced. It is noted that the control signal $C_A$ is generated in the mode decoder 400, and the control signals $C_0$ and $C_A$ are in low level when the mode signal $\mathbf{4}_m$ indicates the first sub-mode in the power saving mode, but the control signal $C_O$ is in low level and the control signal $C_A$ is in high level when the mode signal $\mathbf{4}_m$ indicates the second sub-mode in the power saving mode.

Three gray-scale voltages #0, #31 and #63 obtained in the second sub-mode are supplied to the decoding selecting circuits 30 to 3$x$. Then, in the similar manner, the decoding selecting circuits operate to select any of the gray-scale voltages #0, #31 and #63 according to the control signals $C_0$ and $C_A$. By so doing, the source lines $S_1$ to $S_x$ are supplied with any voltage selected from among the minimum, maximum and intermediate gray-scale voltages.

The power saving mode may be switchable between the first sub-mode and the second sub-mode according to the conditions as appropriate. For example, it is possible to make a switchover to the power saving mode to display in the second sub-mode when a charge level of a battery equipped in a system using the display device decreases by one step from the full-charge level, and when the power is further consumed and the charge level decreases by two steps from the full-charge level, it is possible to display in the first sub-mode. It is thus possible to adopt a display manner with a rougher image and less power consumption as the charge level of the battery decreases. Such a manner is also effective as means for notifying a user of the charge state. In addition, switching between sub-modes can be performed according to user designation, preset time-counting operation and other control adapted to the applied system, as well as being performed according to the charge level of the battery.

In the second sub-mode, since the poor-gray-scale pixels are driven with three gray-scale voltages, it is possible to express total 27 colors by using three gray-scale levels for each of R, G and B pixels. In "27-color image" shown at the right side in FIG. 5, an image displayed by the 27 colors is represented, and in FIGS. 5(*a*), (*b*), (*b*') and (*c*), images obtained in respective arrangement patterns of the rich-gray-scale and poor-gray-scale pixels are represented.

In addition, it may be possible to further set a sub-mode to output four or more gray-scale voltages in the power saving mode. In order to achieve power savings in any sub-mode, it is basically desired to inactivate any voltage dividing resistors and amplifiers by which gray-scale voltages should not be outputted in the gray-scale voltage generating circuit. Various sub-modes would be built out based on such a conception for those skilled in the art. In this regard, Japanese Patent Application Laid-Open No. 2003-22834 by the same applicant as in this application discloses the technique for varying the number of outputs of gray-scale voltages, and can be referred to.

Embodiment 3

In the foregoing, switchover is made between driving of the rich-gray-scale pixels and driving of the poor-gray-scale pixels on a scanning-line basis, but it may be made on a pixel basis.

Figure 9:
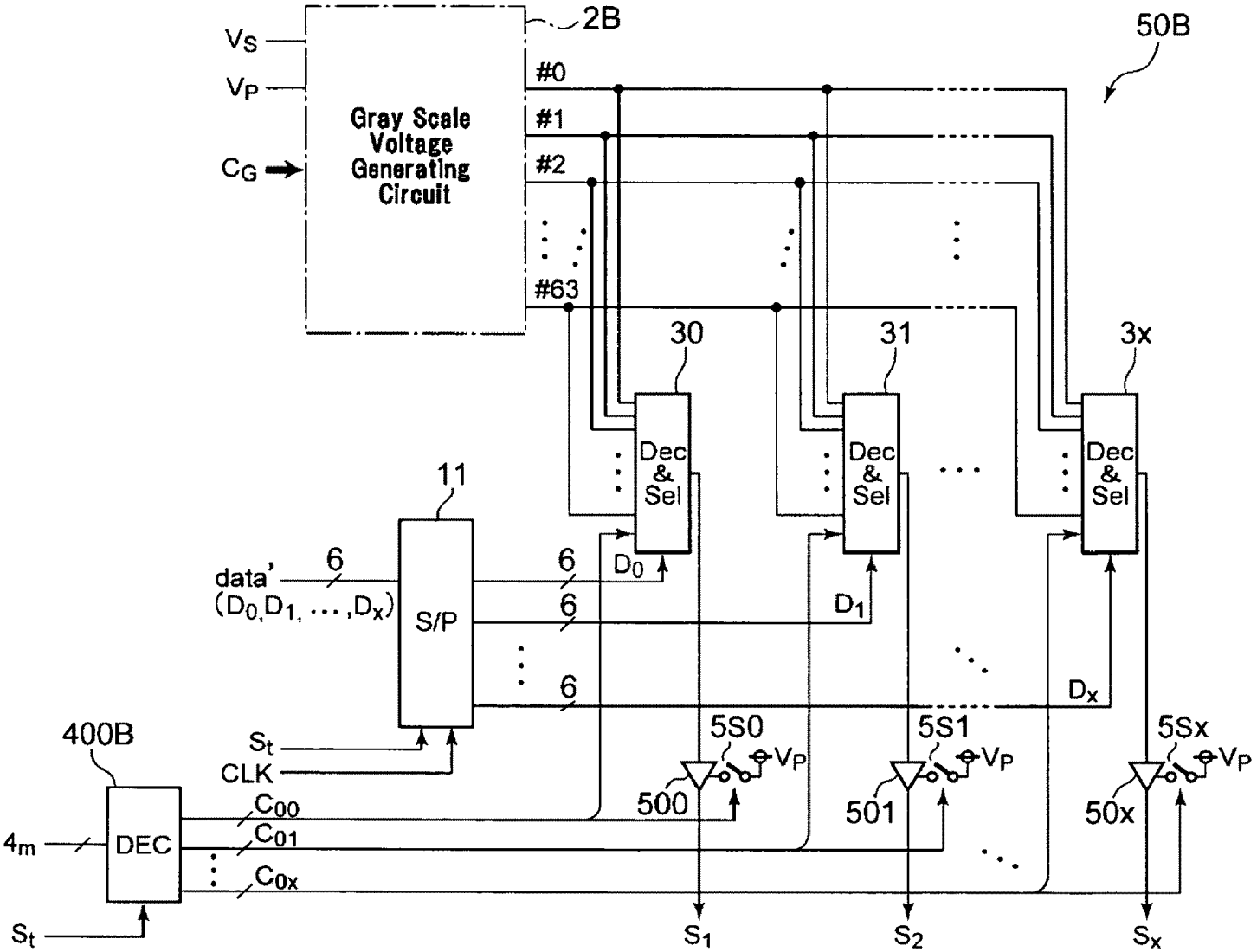
FIG. 9 is a block diagram showing an internal configuration of a source driver according to a third embodiment of the invention.

FIG. 9 illustrates a general configuration of a source driver 50B according to the third embodiment, where a modified mode decoder 400B generates control signals $C_{00}$ to $C_{0x}$ including bits to individually control on/off the power supply control switches 5S1 to 5Sx of the buffer amplifiers in accord with the mode signal $\mathbf{4}_m$. The control signals $C_{00}$ to $C_{0x}$ are also supplied to the decoding selecting circuits 30 to 3$x$, respectively and have further bits to designate a selection state of gray-scale voltages in the decoding selecting circuits.

A gray-scale voltage generating circuit 2B used in the source driver SOB has the configuration shown in FIG. 4 without using the control signal $C_0$ nor having all the switch circuits receiving the control signal $C_0$ as their inputs, where the power supply line is directly connected to the resistors or amplifiers for power supply. Accordingly, the gray-scale voltage generating circuit 2B has such a configuration that the voltage dividing resistors and amplifiers always operate in any mode.

Figure 10:
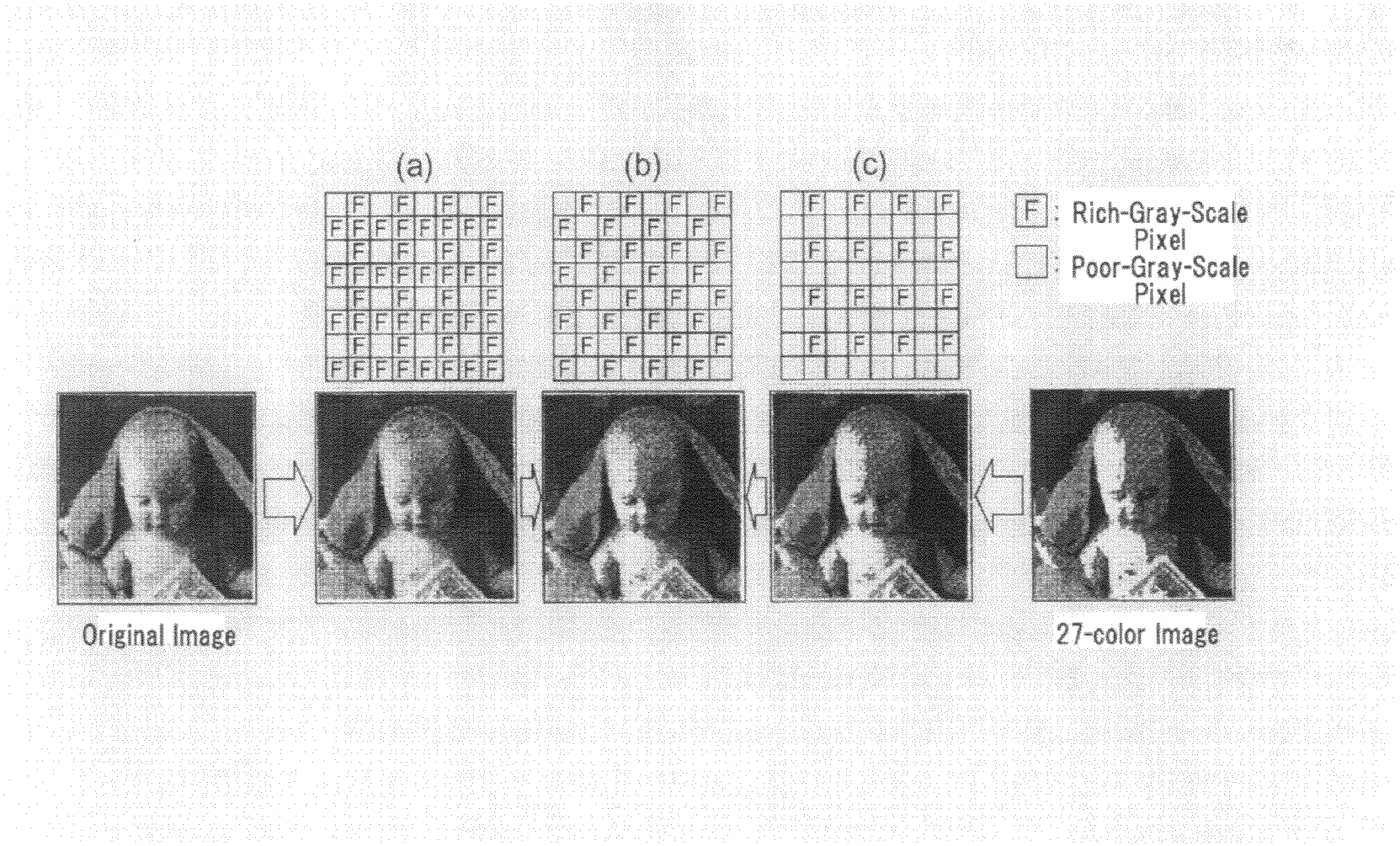
FIG. 10 an illustration of driving manners and actually obtained images in a display area according to the third embodiment of the invention.

FIG. 10 illustrates a driving manner on the display area in the power saving mode implemented by the configuration in FIG. 9.

FIG. 10 is shown in the same way as in FIG. 5. FIG. 10(*a*) shows a manner for alternately repeating a scanning line (poor-gray-scale pixel mixing line) in which driving in two gray scale levels for the poor-gray-scale pixel in the blank field and driving in full gray scale levels for the rich-gray-scale pixel in the field "F" are alternately selected for each pixel, and another scanning line (rich-gray-scale pixel line) in which all the pixels are driven in full gray scale levels. In this manner, the rate of driving in two gray scale levels is 25% that is the same as in FIG. 5(*a*). Other examples to have the same rate may include a manner in which implementing the poor-gray-scale pixel mixing line twice successively, and then implementing the rich-gray-scale pixel line twice successively are repeated.

FIG. 10(*b*) shows a manner where the poor-gray-scale pixel mixing line is repeated, while preventing pixels driven in two gray scale levels from being successive in the same columns on adjacent scanning lines, and a poor-gray-scale pixel and a rich-gray-scale pixel are alternated in the column direction. In other words, any rich-gray-scale pixels are not situated on the upper, lower, left and right of a poor-gray-scale pixel, while any poor-gray-scale pixels are not situated on the upper, lower, left and right of a rich-gray-scale pixel, and either of the poor-gray-scale pixels and the rich-gray-scale pixels appears in the diagonal direction successively. In this manner, the rate of driving in two gray scale levels is 50% that is the same as in FIGS. 5(*b*) and 5(*b*').

FIG. 10(*c*) shows a manner for alternately providing the poor-gray-scale pixel mixing line and the poor-gray-scale pixel line in which all the pixels are driven in two gray scale levels. In this manner, the rate of driving in only two gray scale levels is 75% that is the same as in FIG. 5(*c*). Other examples to have the same rate may include a manner in which the poor-gray-scale pixel mixing line is continued twice, and then, the poor-gray-scale pixel line is continued twice.

Referring to FIG. 9 again, the operation will be described for the case of implementing the driving manner of FIG. 10(*b*).

In this case, the mode decoder 400B receives a mode signal indicating a driving manner in FIG. 10(*b*). Thus, in a period of gray-scale voltage output of some preceding scanning line, the mode decoder 400B sets each of the decoding selecting circuits 30 to 3$x$ at either a first state to select a gray-scale voltage for the poor-gray-scale pixel or a second state to select a gray-scale voltage for the rich-gray-scale pixel by predetermined bits of the control signals $C_{00}$ to $C_{0x}$. In this embodiment, the decoding selecting circuit 30 is set at the first state to select either gray-scale voltage #0 or #63, the decoding selecting circuit 31 is set at the second state to select any of all gray-scale voltages #0 to #63, . . . , the decoding selecting circuit 3$x$ is set at the second state to select any of all gray-scale voltages #0 to #63. Concurrently, other predetermined bits of the control signals $C_{00}$ to $C_{0x}$ turn on the switches 5S0 to 5Sx to supply power to the buffer amplifiers 500 to 50$x$, respectively. By this means, gray-scale voltages selected from the gray-scale voltages #0 and #63 and gray-scale voltages selected from the gray-scale voltages #0 to #63 are outputted to alternately appear spatially for each source line i.e. each pixel.

In another period of gray-scale voltage output of the following scanning line, the mode decoder 400B sets each of the decoding selecting circuits 30 to 3*x* at either a first state to select a gray-scale voltage for the poor-gray-scale pixel or a second state to select a gray-scale voltage for the rich-gray-scale pixel by predetermined bits of the control signals $C_{00}$ to $C_{0x}$, with the first state and the second state now being reversed compared to in the period of gray-scale voltage output of the last scanning line. In this embodiment, the decoding selecting circuit 30 is set at the second state to select any of gray-scale voltages #0 to #63, the decoding selecting circuit 31 is set at the first state to select either of the gray-scale voltage #0 and #63, . . . , the decoding selecting circuit 3*x* is set at the first state to select either of the gray-scale voltage #0 and #63. Then, other predetermined bits of the control signals $C_{00}$ to $C_{0x}$ turn on the switches 5S0 to 5Sx to supply power to the buffer amplifiers 500 to 50*x*. By this means, gray-scale voltages selected from the gray-scale voltages #0 and #63 and gray-scale voltages selected from the gray-scale voltages #0 to #63 are outputted to alternately appear spatially for each pixel in an inverse form to the last time.

By repeating the operation on the preceding scanning line and the subsequent scanning line as described above, the driving manner as shown in FIG. 10(*b*) is achieved.

In this example, the selection state of each of the decoding selecting circuits 30 to 3*x* is switched between the first state and second state whenever the target scanning line is changed. Further, the driving manner in FIG. 10(*a*) is implemented by control of causing the first state and second state to appear alternately for each pixel in a scanning line, while selecting and outputting any one from all the gray-scale voltages in another scanning line. Furthermore, the driving manner in FIG. 10(*c*) is implemented by control of causing the first state and second state to appear alternately for each pixel on a scanning line, while further causing only the first state to appear on another scanning line (i.e. driving all the pixels as the poor-gray-scale pixels).

Although only typical examples are shown in FIGS. 5 and 10, driving in various manners can be performed by widely applying techniques derived from the above descriptions. As well as a manner of the arrangement of the rich-gray-scale pixels and poor-gray-scale pixels simply on the display area, it is possible to perform display with varying the arrangement manner on the time series. For example, it is possible to mix or alternate a frame with the driving shown in FIG. 5(*b*) and another frame with the driving shown in FIG. 10(*b*). Further, not limiting to two types, a sequence can be configured with three or more types of frames.

Figure 11:
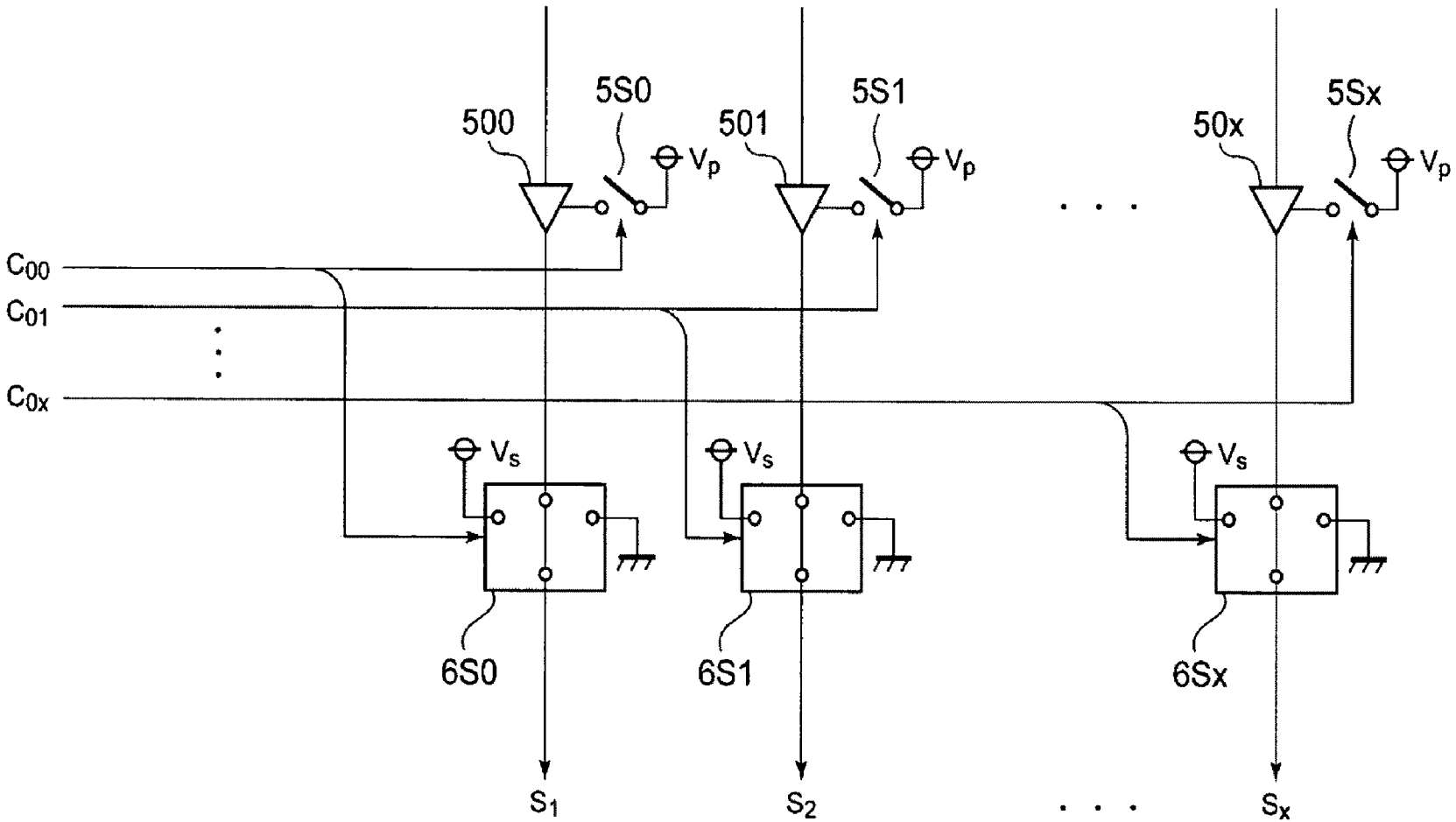
FIG. 11 is a block diagram showing a configuration of an output stage of the source driver according to a modification in the invention.

In this embodiment, since the voltage dividing resistors and amplifiers in the gray-scale voltage generating circuit 2B are always operated, the effect is not expected to reduce power consumed in the resistors and amplifiers unlike the configuration explained with reference to FIGS. 4 and 8. However, in the driving manner as shown in FIG. 10(*c*), when pixels of one scanning line are all driven as poor-gray-scale pixels, it is possible to disconnect the power supply to the corresponding buffer amplifiers to pass the gate lines, and decrease the refresh rate, and so in this respect, the power consumption reduction effect is expected. Further, even in the driving manners as shown in FIGS. 10(*a*) and (*b*), by adopting the configuration as shown in FIG. 11 on the output side of the decoding selecting circuits, power consumption is reduced. More specifically, in FIG. 11, three-state switches 6S0 to 6Sx are inserted between outputs of the buffer amplifiers 5S0 to 5Sx and the source lines $S_1$ to $S_x$, respectively. In each of the three-state switches, three selected terminals are respectively coupled to the power supply voltage Vs, a buffer amplifier output and a ground point, and a non-selection terminal is coupled to a source line. Further, control terminals of the three-state switches 6S0 to 6Sx are respectively supplied with predetermined bits of the control signals $C_{00}$ to $C_{0x}$. According to the output stage with such a configuration, when driving the rich-gray-scale pixels, the buffer amplifiers are turned on, and the three-state switches are controlled to select outputs of the buffer amplifiers. Meanwhile, when driving the poor-gray-scale pixels (in this case, pixels in the two gray-scale levels), the buffer amplifiers are turned off, and the three-state switches are controlled to select either the power supply voltage Vs or a ground point potential. Accordingly, power consumption for the buffer amplifiers having been turned off in driving the poor-gray-scale pixels is cut. The predetermined bits of the control signals $C_{00}$ to $C_{0x}$ supplied to the three-state switches 6S0 to 6Sx have values corresponding to the pixel data, and the three-state switches select the power supply voltage Vs or the ground point potential in accordance with the pixel data.

Further, in the driving on a pixel basis shown in FIG. 10, the rich-gray-scale pixels and poor-gray-scale pixels can be mixed finely with compared to the driving on a scanning-line basis shown in FIG. 5, and thereby the resultant synthetic image can generally be close to the original image but depending on the image object.

In the driving manner shown in FIG. 10, it is naturally possible to display the poor-gray-scale pixels in three or more gray-scale levels and/or stepwise vary the number of gray-scale levels as described previously. In this case, the decoding selecting circuits 30 to 3*x* are set at either a state to select any from all the gray-scale voltages or a state to select any from three or more gray-scale voltages, corresponding to the step in accordance with the control signals $C_{00}$ to $C_{0x}$.

Embodiment 4

In the foregoing, a value of a poor-gray-scale pixel is uniquely obtained from an original value of the pixel, in other words, the corresponding value of a poor-gray-scale pixel is obtained by subjecting the original value of the pixel to rough assignment of gray scale. Alternatively, a value of a poor-gray-scale pixel can be obtained using dithering processing as described below. In general, the dithering processing applied herein is to derive a value of each pixel obtained from a result of distributing dark and light pixels in a region of a plurality of pixels in accord with the original values of the pixels, for example, with a density corresponding to the average value.

Figure 12:
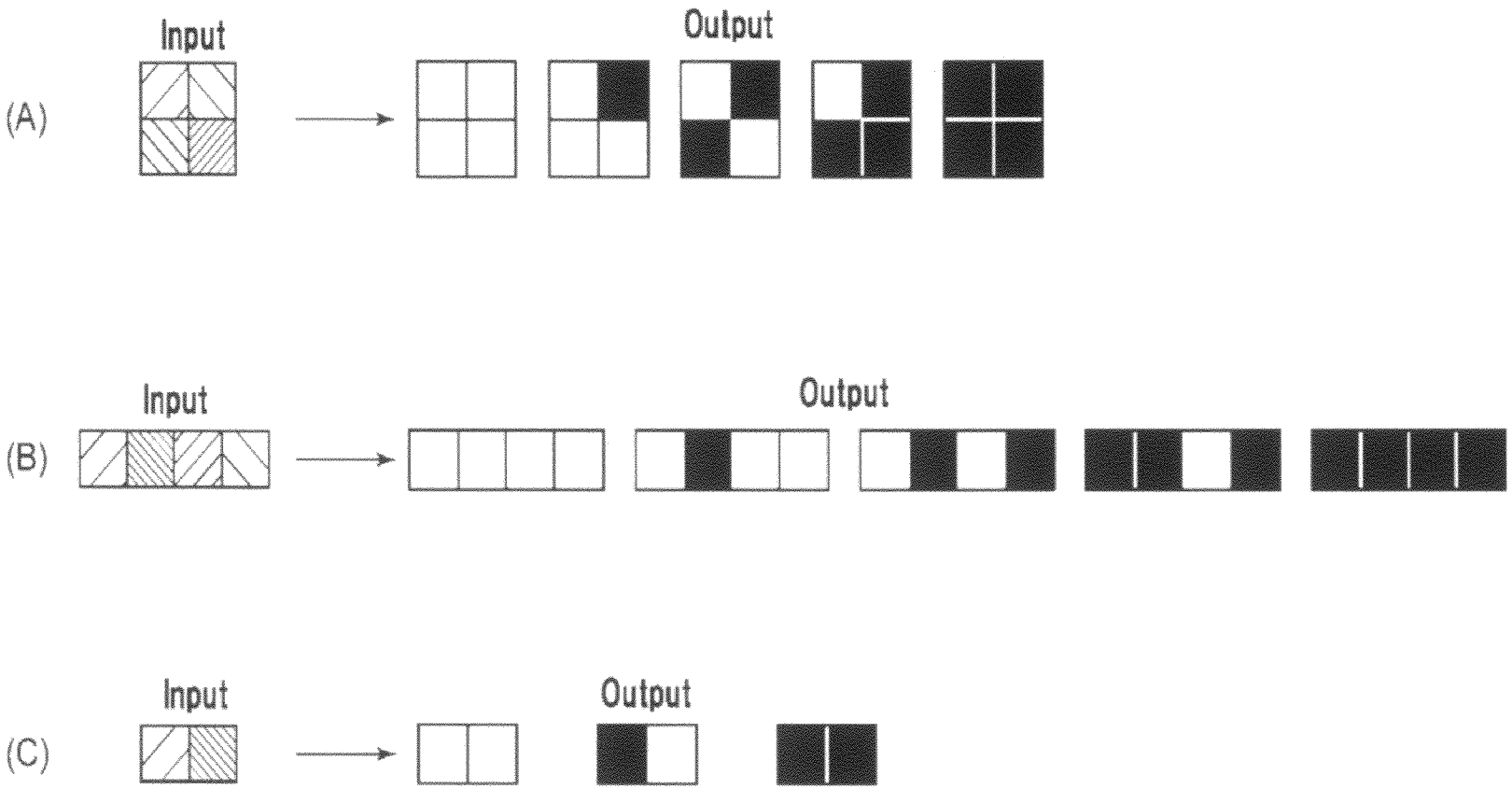
FIG. 12 is a schematic illustration for explaining a basic scheme of dithering processing applied in the invention.

FIG. 12 schematically shows a basic way of the dithering processing, where (A) shows an example of a 2×2 pixel block as a processing unit, (B) shows an example of a 1×4 pixel block as a processing unit, and (C) shows an example of a 1×2 pixel block as a processing unit.

In either example, when receiving input values of pixels of a predetermined block, these values are averaged, and in the density corresponding to the obtained average value, the distribution of the darkest value (or brightest value) to output is determined for the pixels of that block. Shown at the right side in the figure are distributional states of the outputs, where as viewed to the right, the density of the darkest pixels increases and the lightness decreases in the region of the block. From the state without any darkest pixels to the state all occupied by the darkest pixels, (A) and (B) take five states for output, and (C) takes three states for output. Thus, the lightness-corresponding value of the entire region of a predetermined block is calculated from the input pixels of the block each having its value, it is possible to express three or more gray-scale levels in the region, of the entire pixel block only by two gray-scale levels, darkest and lightest by determining the distributional state of the darkest and lightest pixels in the block in accordance with the lightness-corresponding value.

Figure 13:
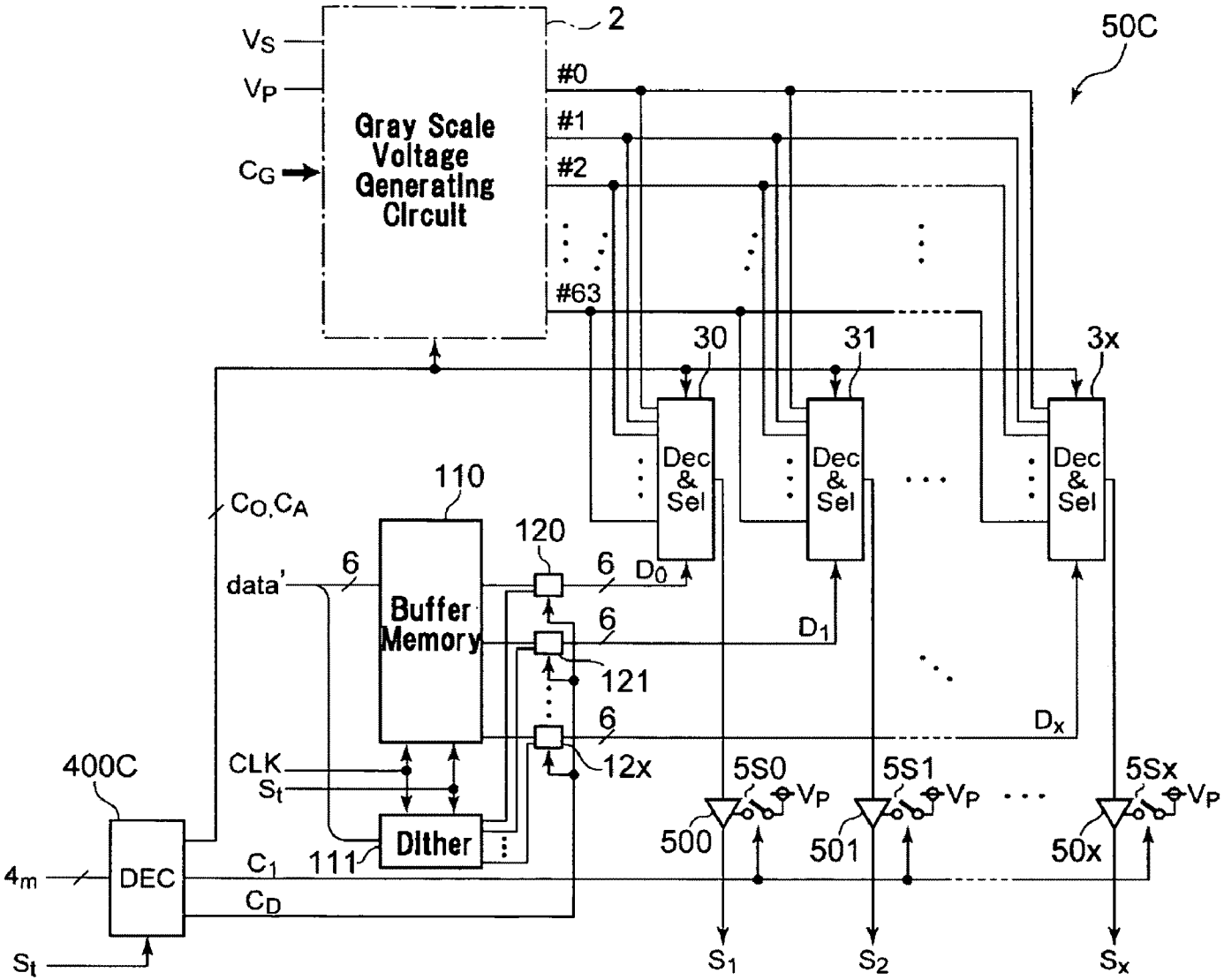
FIG. 13 is a block diagram showing an internal configuration of a source driver according to a fourth embodiment of the invention.

FIG. 13 illustrates a source driver 50C in this embodiment of the invention, to which the above-mentioned dithering processing are applied.

In FIG. 13, a dithering processing circuit 111 is provided, to which image data (data') is supplied. The dithering processing circuit 111 is further supplied with the clock signal CLK and timing signal St, and its input/output control of the image data (data') is specified based on the signals. The dithering processing circuit 111 captures input image data sequentially, while performing the above-mentioned dithering processing for each predetermined pixel block. The dithering processing circuit 111 also has a memory function of storing the image data of one frame obtained by the processing.

The configuration in FIG. 13 substitutes a buffer memory 110 for the data converting circuit 11 the memory capturing the image data (data') sequentially and storing the image data of one frame. Further, the configuration is provided with selectors 120, 121, . . . , 12*x* for selecting any of an output of the buffer memory 110 and an output of the dithering processing circuit 111 for each pixel data block, and outputs of the selectors are inputted to the decoding selecting circuits 30 to 3*x*.

A control signal $C_D$ from a mode decoder 400C is commonly supplied to selection control terminals of the selectors 120 to 12*x*. When the mode signal $\mathbf{4}_m$ indicates any of sub-modes of the power saving mode, the mode decoder 400C sets the control signal $C_D$ at a high level in a horizontal scanning period for driving poor-gray-scale pixels, while setting the signal at a low level in other horizontal scanning period. In response thereto, the selectors 120 to 12*x* relay an output of the dithering processing circuit 111 when the control signal $C_D$ is in a high level, and an output of the buffer memory 110 when the control signal $C_D$ is in a low level, to the decoding selecting circuits 30 to 3*x*.

Figure 14:
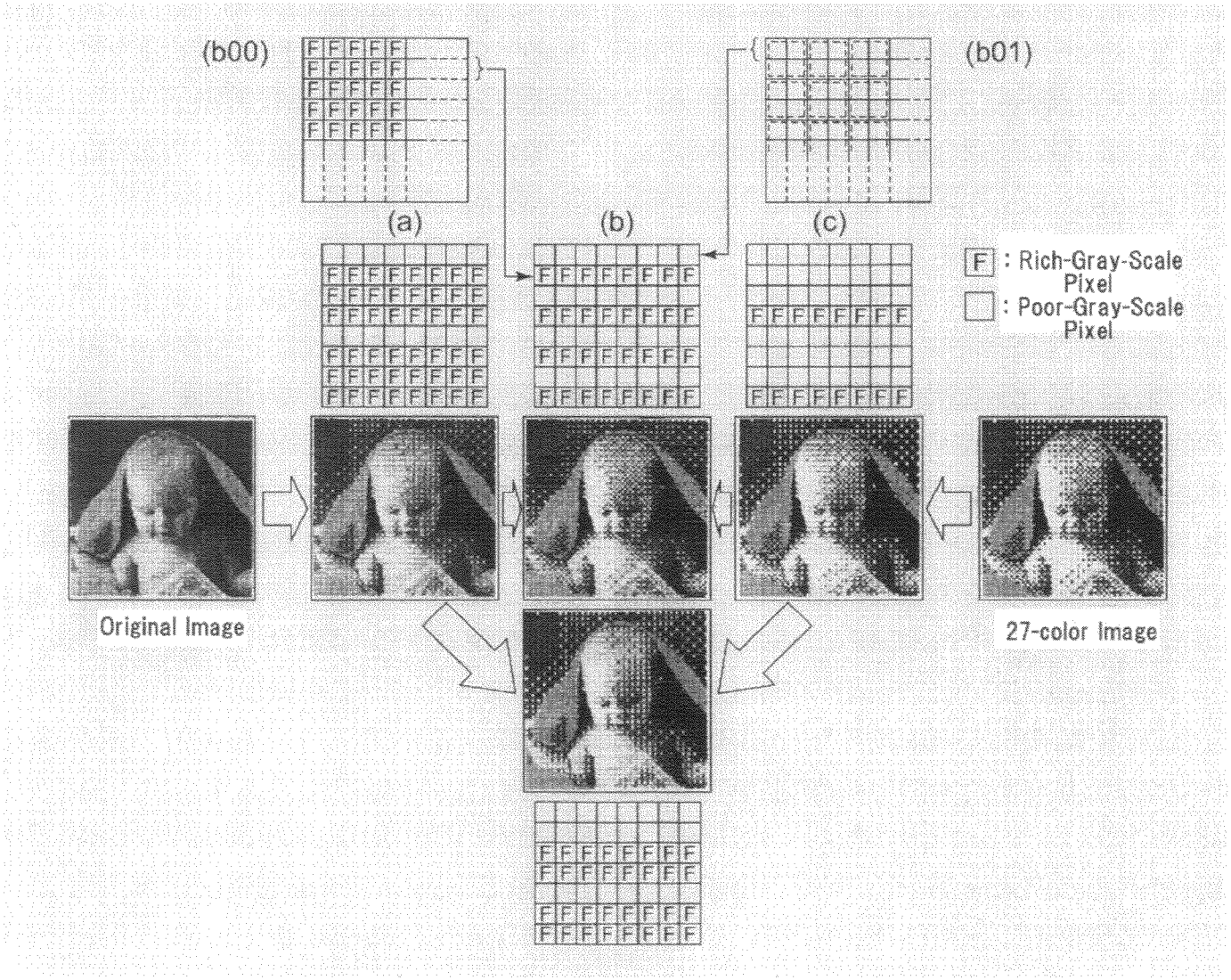
FIG. 14 is an illustration of driving manners and actually obtained images in a display area according to the fourth embodiment of the invention.

Based on the aforementioned configuration, in implementing the driving manner shown in FIG. 14(*b*) using the processing scheme shown in FIG. 12(A) for example, the buffer memory 110 forms pixel data of the rich-gray-scale pixels for one frame as shown in FIG. 14(*b*00) while the dithering processing circuit 111 forms pixel data of the poor-gray-scale pixels for one frame as shown in FIG. 14(*b*01), and such operation is repeated that the image data obtained from the dithering processing circuit 111 is outputted to the decoding selecting circuits 30 to 3*x* for a preceding scanning line while the image data obtained from the buffer memory 110 is outputted to the decoding selecting circuits 30 to 3*x* for the subsequent scanning line. Such selectively outputting of the dithering processing circuit 11 and buffer memory 110 is achieved using the control signal $C_D$. In this case, the control signal $C_D$ is switched between a high level and a low level alternately for each horizontal scanning period.

Also in implementing other processing scheme and driving manner, the rich-gray-scale pixel data of one frame and the poor-gray-scale pixel data of one frame obtained by the dithering processing is once obtained, and by switching the control signal $C_D$ according to the scheme and manner to implement, it is possible to output necessary pixel data to the decoding selecting circuits.

It is noted that, as can be seen from FIG. 14, in implementing the driving manner shown in (b) for example, half the image data obtained by dithering becomes unnecessary, thus being not efficient. In order to dissolve the inefficiency, the dithering processing as shown in FIG. 12(B) or (C) is performed wherein a block associated with a single line is used as a processing unit, and thereby pixel data required for dithering is only obtained. In other words, in a line-to-line mixing pattern of rich-gray-scale and poor-gray-scale pixels, by performing dithering for each block formed within a line and further only on the required blocks, it is possible to perform efficient processing. Also in other driving manners, there can be selected a block which is adapted to the driving manner and enables efficient dithering processing.

Embodiment 5

Figure 15:
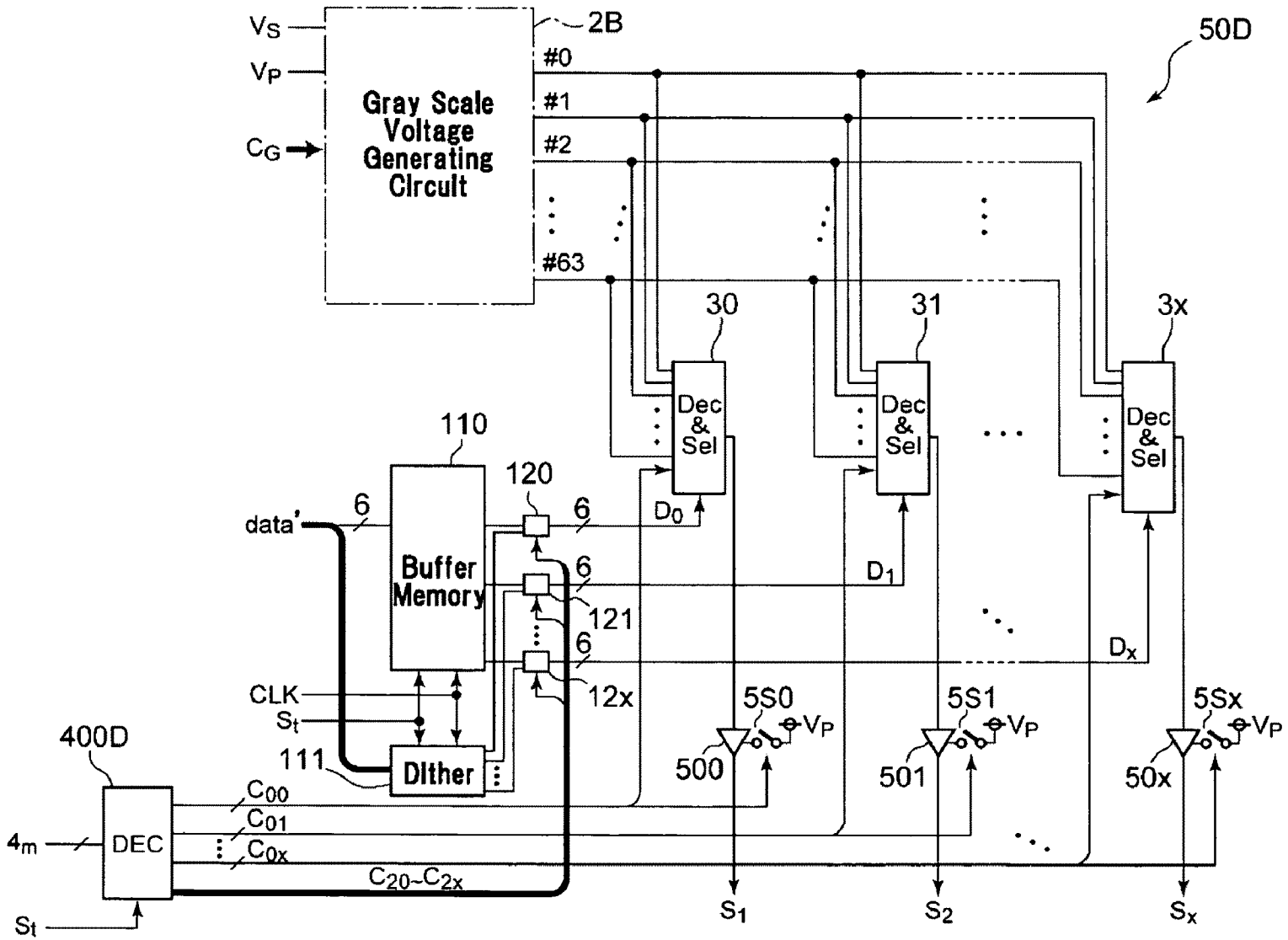
FIG. 15 is a block diagram showing an internal configuration of a source driver according to a fifth embodiment of the invention.

FIG. 15 illustrates a source driver 50D according to still another embodiment, and provides a configuration to drive poor-gray-scale pixels for each pixel.

The configuration in FIG. 15 is obtained by applying the above-mentioned dithering processing to the configuration in FIG. 9 as a base. A mode decoder 400D supplies control signals $C_{20}$ to $C_{2x}$ respectively to the selectors 120 to 12*x*. The control signals $C_{20}$ to $C_{2x}$ are capable of separately controlling the selectors 120 to 12*x*, and enable the selectors to select any of an output of the buffer memory 110 and an output of the dithering processing circuit 111 with respect to each of the pixel data $D_0$, $D_1$, . . . , $D_x$.

When the mode signal $\mathbf{4}_m$ indicates any of sub-modes of the power saving mode, the mode decoder 400D sets the corresponding control signals of the control signals $C_{20}$ to $C_{2x}$ at a high level for pixel data for driving the poor-gray-scale pixels, while setting the corresponding ones of the same at a low level for pixel data for driving the rich-gray-scale pixels. In response to the respective control signals, the selectors 120 to 12*x* relay to the respective decoding selecting circuits 30 to 3*x* outputs of the dithering processing circuit 111 when the control signal is in a high level and outputs of the buffer memory 110 when the control signal is in a low level. Driving of poor-gray-scale pixels is thus achieved for each pixel.

Figure 16:
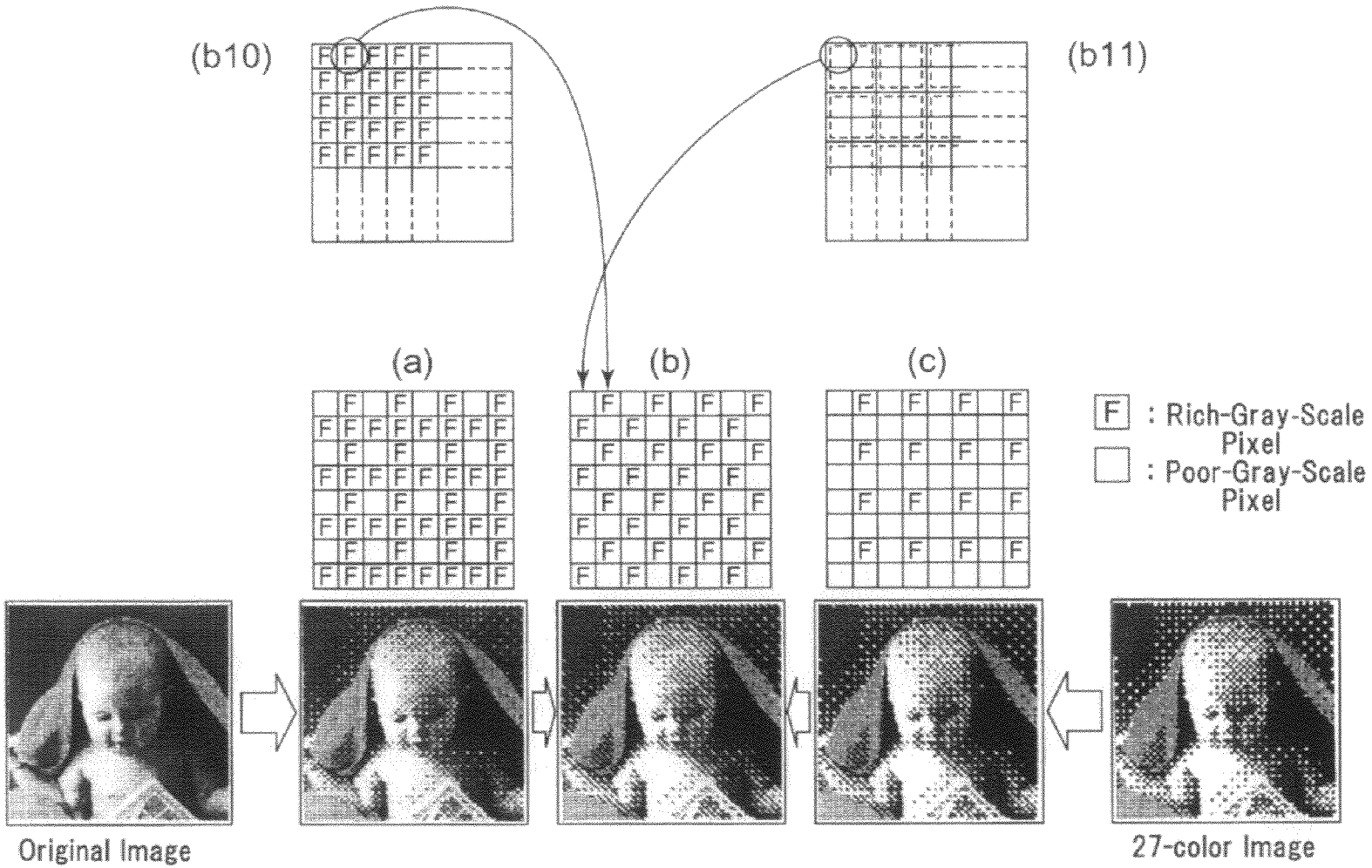
FIG. 16 is an illustration of driving manners and actually obtained images in a display area according to the fifth embodiment of the invention.

Based on the aforementioned configuration in implementing the driving manner shown in FIG. 16(*b*) using the processing scheme shown in FIG. 12(A), for example, the buffer memory 110 forms pixel data of the rich-gray-scale pixels for one frame as shown in FIG. 16(*b*10), while the dithering processing circuit 111 forms pixel data of the poor-gray-scale pixels for one frame as shown in FIG. 16(*b*11) in the same way as described in FIG. 14. Then, in each horizontal scanning period, the poor-gray-scale pixel data obtained from the dithering processing circuit 111 for a pixel and the rich-gray-scale pixel data obtained from the buffer memory 110 for the adjacent pixel are alternately outputted to the decoding selecting circuits 30 to 3*x*. Further, herein, whenever the scanning line is changed, the sequence of the poor-gray-scale pixel data and rich-gray-scale pixel data is reversed. Selectively outputting of the dithering processing circuit 111 and buffer memory 110 is achieved using the control signals $C_{20}$ to $C_{2x}$. In this case, the control signals $C_{20}$ to $C_{2x}$ are set at low level, high level, low level, . . . in this order after being set at high level, low level, high level, . . . in a horizontal scanning period in this order, respectively.

Also in implementing other processing scheme and driving manner, the rich-gray-scale pixel data of one frame and the poor-gray-scale pixel data of one frame obtained by the dithering processing are once obtained, and by switching each of the control signals $C_{20}$ to $C_{2x}$ according to the scheme and manner to implement, it is possible to output necessary pixel data to the decoding selecting circuits.

At the right side in FIGS. 14 and 16, there are shown 27-color images obtained by using the processing scheme as shown in FIG. 12(C), and images are shown which are displayed in respective driving manners using the 27-color image and original image (at the left in the figure).

Figure 17:
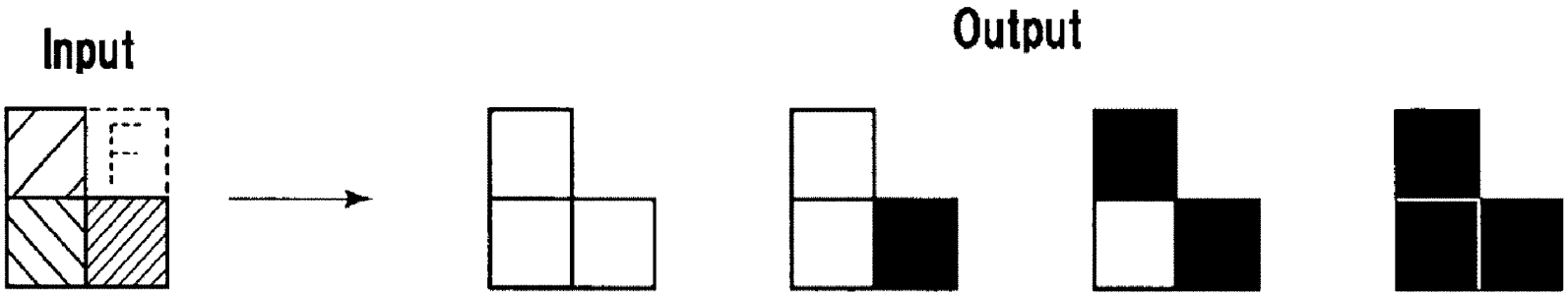
FIG. 17 is a schematic illustration for explaining another scheme of the dithering processing applied in the invention.

There are various dithering processing schemes other than those as shown in FIG. 12, and it is possible to appropriately adopt any adapted to an applied display system. Further, it is possible to vary the distribution of the darkest pixels in the output as appropriate, even in the same processing scheme. For example, the output manner at the middle in FIG. 12(A) is designed to provide the darkest pixels at upper right and lower left, but may be designed to switch such pixels to be placed at upper left and lower right. Further, as can be seen from FIG. 16, there is a risk also that the image data obtained by dithering becomes waste. In order to dissolve the risk, in implementing the driving manner shown in FIG. 16(*c*), for example, the dithering processing is performed in such a manner that a processing unit is assigned to a block just consisting of pixels used as poor-gray-scale pixels as shown in FIG. 17, whereby it is possible to eliminate wastefully processed data, and obtain only data of pixels necessary for dithering so as to lead to efficient processing. Also in other driving manners, the same conception may be realized by determining a block which is adapted to the associated driving manner and allows dithering processing to be efficient.

In the fourth and fifth embodiments, for simplicity of descriptions, the amount of data to store in the buffer memory 10 and dithering processing circuit 111 is one frame, but it is not essential, and it is apparent that the required amount of data suffices and is determined as appropriate.

Figure 18:
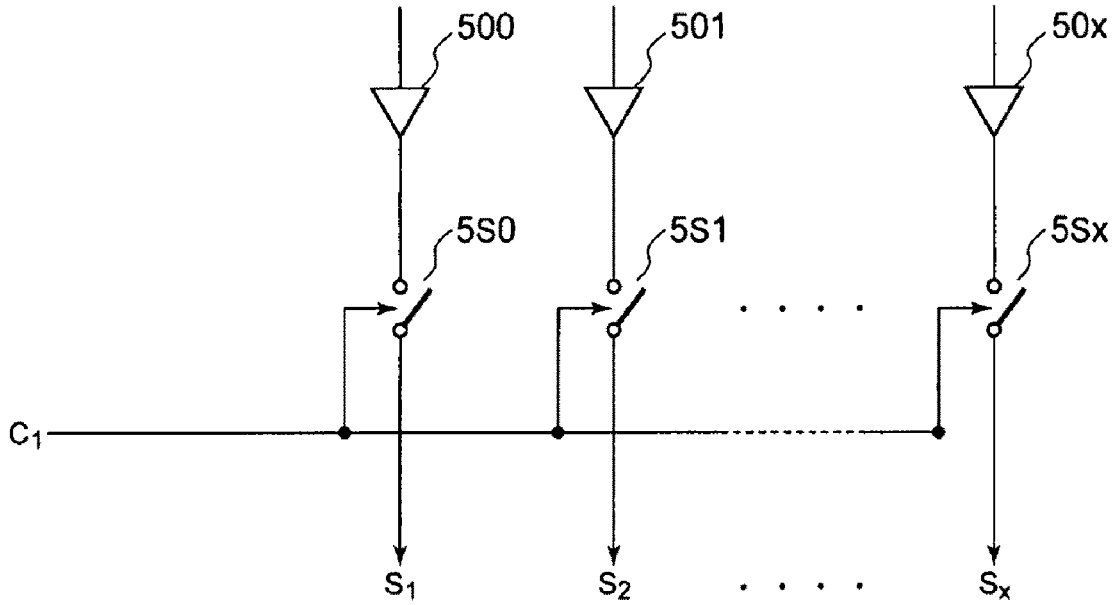
FIG. 18 is a block diagram showing a configuration of a gray-scale voltage outputting stage in a modified form of each of embodiments.

It has been described in the first and third embodiments that power supply to the buffer amplifiers 500 to 50*x* is off for a low-rate refresh line, and the gate driver 60 skips scanning of the low-rate refresh line and scans only a high-rate refresh line. In this case, controlled is only the output timing of gray-scale voltages for the rich-gray-scale pixels. As a modification of the configuration for turning off the buffer amplifiers, as shown in FIG. 18, it may be possible that the switches 5S0 to 5Sx are connected in series to output lines of the decoding selecting circuits 30 to 3*x* or outputs of the buffer amplifiers 500 to 50*x* inserted to the lines, and the switches are made open in accord with the control signal $C_1$, whereby the decoding selecting circuits 30 to 3*x* are halted and outputs of the poor-gray-scale pixel information signals are off. Similar modification applies to the configuration shown in FIG. 9.

Further, power savings may not be always aim, and for example, image display with the poor-gray-scale pixels mixed as described above may be aimed at the so-called BGV (Background Video) etc. In this case, characteristic images are obtained which are different from the original image as shown in FIGS. 5, 10, 14 and 16, but the invention has such an advantage that it is possible to achieve display of the characteristic images in lower power consumption.

While the transmissive type display panel has been described so far, the invention is applicable to a reflective type display panel and a so-called transflective type display panel. Further, the invention is not necessarily limited to the active matrix type, and basically it is also applicable to a passive matrix type display panel. Furthermore, while the TFT is described as an example in the foregoing, it may be possible to use pixel driving elements other than the TFT.

Moreover, the liquid crystal display panel is used as a display panel in each of the above-mentioned embodiments, but the invention is not limited thereto, and obviously it is applicable to other types of display panels such as an EL (electroluminescent) display.

Although representative embodiments according to the invention are described above, the invention is not limited them, and various modifications can be conceived by those skilled in the art within the scope of the appended claims.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A matrix addressing method for driving pixels arranged over a display area by signals supplied to row electrodes and column electrodes arranged to cross one another, the method comprising the following steps of:

generating rich-gray-scale pixel information signals in a predetermined number of levels of gray scale in accordance with original pixel information signals;

generating poor-gray-scale pixel information signals in a smaller number of levels of gray scale than the predetermined number of levels of gray scale in according with original pixel information signals, wherein the poor-gray-scale pixel information signals are obtained by performing a dithering processing on the original pixel information signals; and discretely mixing rich-gray-scale pixels driven by the rich-gray-scale pixel information signals and poor-gray-scale pixels driven by the poor-gray-scale pixel information signals to coexist in at least a part of the display area in a predetermined mixing pattern to display the same image object in a predetermined mode, wherein the poor-gray-scale pixels are driven by the poor-gray-scale pixel information signals at a lower frequency than that of the rich-gray-scale pixels, wherein gamma correction characteristics are applied to the rich-gray-scale pixel information signals, and wherein the gamma correction characteristics are variable in according with a spatial arrangement manner in the display area of the poor-gray-scale pixels driven by the poor-gray-scale pixel information signals, an input instruction or other setting.

2. The method as claimed in claim 1, wherein the mixing pattern and/or a ratio between the number of the rich-gray-scale pixels and the number of the poor-gray-scale pixels are/is variable.

3. The method as claimed in claim 1, wherein in driving the poor-gray-scale pixels at the lower frequency, row electrode selecting operation is performed to select only part of the row electrodes associated with the rich-gray-scale pixels while passing other part of the row electrodes associated with only the poor-gray-scale pixels.

4. The method as claimed in claim 1, wherein the poor-gray-scale pixel information signals only include a signal with a minimum driving level of the pixel and a signal with a maximum driving level of the pixel.

5. The method as claimed in claim 1, wherein an arrangement of the rich-gray-scale pixels and the poor-gray-scale pixels in the display area is switched at predetermined timing or periodically.

6. A matrix addressing circuit for driving pixels arranged across a display area by signals supplied to row electrodes and column electrodes arranged to be mutually crossed, comprising:

a rich-gray-scale generating unit generating rich-gray-scale pixel information signals in a predetermined number of levels of gray scale in accordance with original pixel information signals;

a poor-gray-scale generating unit generating poor-gray-scale pixel information signals in a smaller number of levels of gray scale than the predetermined number of levels of gray scale in accordance with original pixel information signals;

a mixing control unit discretely mixing rich-gray-scale pixels driven by the rich-gray-scale pixel information signals and poor-gray-scale pixels driven by the poor-gray-scale pixel information signals to coexist in at least a part of the display area in a predetermined mixing pattern to display the same image object in a predetermined mode, wherein the rich-gray-scale generating unit comprises a gray-scale voltage generating circuit with amplifiers respectively receiving a plurality of gray-scale voltages having gradually level-shifted values, and a selecting circuit that selects any of outputs of the amplifiers for each pixel or each predetermined display unit in accordance with a pixel information signal indicating a level of gray scale of the pixel or the display unit and outputs it as the rich-gray-scale pixel information signals, and the poor-gray-scale generating unit comprises a switch circuit which disconnects power supply to all the amplifiers or connects power supply only to a predetermined number of amplifiers corresponding to predetermined gray scale levels among the all amplifiers while disconnecting power supply to the other amplifiers in the predetermined mode, and a setting circuit setting the selecting circuit in a condition to select either of a power supply voltage and a ground voltage and/or any of output signals of the amplifiers given the power supply in accordance with a selection control signal responsive to the original pixel information signal in the predetermined mode to output the selected one as the poor-gray-scale pixel information signal, and wherein the poor-gray-scale generating unit comprises a signal processing circuit that performs dithering processing on the original pixel information signal, an output of the signal processing circuit being used as the selection control signal in the predetermined mode; and a buffer amplifier or a switch supplied with an output signal of the selecting circuit, wherein, in the predetermined mode, the buffer amplifier or switch is controlled to output the poor-gray-scale pixel information signal during a prescribed frame of a sequence consisting of a plurality of frames and to break the output of the poor-gray-scale pixel information signal in at least one remainder frame of the sequence.

7. The circuit as claimed in claim 6, wherein the mixing control unit comprises a supplying unit supplying a control signal to the switch circuit and the selecting circuit in the predetermined mode to switch between one state where the selecting circuit outputs the rich-gray-scale pixel information signal and the other state where the selecting circuit outputs the poor-gray-scale pixel information signal for each scanning line or each pixel in accordance with the predetermined mixing pattern.

8. The circuit as claimed in claim 6, further comprising:

a row electrode driving unit performing row electrode selecting operation to select only a part of the row electrodes associated with the rich-gray-scale pixels while passing other part of the row electrodes associated with only the poor-gray-scale pixels in the predetermined mode, wherein the row electrode is passed corresponding to an output breaking state of the poor-gray-scale pixel information signal.

9. The circuit as claimed in claim 6, wherein the predetermined mode includes a plurality of sub-modes, and the gray-scale voltage generating circuit is set with amplifiers to be powered for each sub-mode.

10. A display device using a matrix addressing circuit for driving pixels arranged across a display area by signals supplied to row electrodes and column electrodes arranged to be mutually crossed, the matrix addressing circuit comprising:

rich-gray-scale generating unit generating rich-gray-scale pixel information signals in a predetermined number of levels of gray scale in accordance with original pixel information signals;

poor-gray-scale generating unit generating poor-gray-scale pixel information signals in a smaller number of levels of gray scale than the predetermined number of levels of gray scale in accordance with original pixel information signals; and mixing control unit coupled to the rich-gray-scale generating unit and the poor-gray-scale generating unit discretely mixing rich-gray-scale pixels driven by the rich-gray-scale pixel information signals and poor-gray-scale pixels driven by the poor-gray-scale pixel information signals to coexist in at least a part of the display area in a predetermined mixing pattern to display the same image object in a predetermined mode, wherein the rich-gray-scale generating unit comprises a gray-scale voltage generating circuit with amplifiers respectively receiving a plurality of gray-scale voltages having gradually level-shifted values, and a selecting circuit that selects any of outputs of the amplifiers for each pixel or each predetermined display unit in accordance with a pixel information signal indicating a level of gray scale of the pixel or the display unit and outputs it as the rich-gray-scale pixel information signals, and the poor-gray-scale generating unit comprises a switch circuit which disconnects power supply to all the amplifiers or connects power supply only to a predetermined number of amplifiers corresponding to predetermined gray scale levels among the all amplifiers while disconnecting power supply to the other amplifiers in the predetermined mode, and a setting circuit coupled to the selecting circuit setting the selecting circuit in a condition to select either of a power supply voltage and a ground voltage and/or any of output signals of the amplifiers given the power supply in accordance with a selection control signal responsive to the original pixel information signal in the predetermined mode to output the selected one as the poor-gray-scale pixel information signal, and wherein the poor-gray-scale generating unit comprises a signal processing circuit that performs dithering processing on the original pixel information signal, an output of the signal processing circuit being used as the selection control signal in the predetermined mode; and a buffer amplifier or a switch coupled to the selecting circuit and supplied with an output signal of the selecting circuit, wherein, in the predetermined mode, the buffer amplifier or switch is controlled to output the poor-gray-scale pixel information signal during a prescribed frame of a sequence consisting of a plurality of frames and to break the output of the poor-gray-scale pixel information signal in at least one remainder frame of the sequence.

11. The device as claimed in claim 10, wherein the mixing control unit comprises a supplying unit coupled to the switch circuit and the selecting circuit, supplying a control signal to the switch circuit and the selecting circuit in the predetermined mode to switch between one state where the selecting circuit outputs the rich-gray-scale pixel information signal and the other state where the selecting circuit outputs the poor-gray-scale pixel information signal for each scanning line or each pixel in accordance with the predetermined mixing pattern.

12. The device as claimed in claim 10, wherein the matrix addressing circuit further comprising:

a row electrode driving unit performing row electrode selecting operation to select only a part of the row electrodes associated with the rich-gray-scale pixels while passing other part of the row electrodes associated with only the poor-gray-scale pixels in the predetermined mode, wherein the row electrode is passed corresponding to an output breaking state of the poor-gray-scale pixel information signal.

13. The device as claimed in claim 10, wherein the predetermined mode includes a plurality of sub-modes, and the gray-scale voltage generating circuit is set with amplifiers to be powered for each sub-mode.

* * * * *